US009075349B2

(12) United States Patent
Komatsuzaki et al.

(10) Patent No.: US 9,075,349 B2
(45) Date of Patent: Jul. 7, 2015

(54) IMAGE FORMING APPARATUS AND IMAGE FORMING METHOD

(71) Applicant: FUJI XEROX CO., LTD., Minato-ku, Tokyo (JP)

(72) Inventors: Kazunari Komatsuzaki, Kanagawa (JP); Nobuhiro Katsuta, Kanagawa (JP); Satoshi Tatsuura, Kanagawa (JP); Yutaka Nogami, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 105 days.

(21) Appl. No.: 14/068,684

(22) Filed: Oct. 31, 2013

(65) Prior Publication Data

US 2014/0376967 A1 Dec. 25, 2014

(30) Foreign Application Priority Data

Jun. 20, 2013 (JP) ..... 2013-129866

(51) Int. Cl.
*G03G 15/10* (2006.01)

(52) U.S. Cl.
CPC ..... *G03G 15/101* (2013.01)

(58) Field of Classification Search
CPC ..... G03G 15/101
USPC ..... 399/237, 250, 341
See application file for complete search history.

(56) References Cited

U.S. PATENT DOCUMENTS

2002/0031372 A1 3/2002 Iida et al.
2013/0209150 A1 * 8/2013 Kamoda et al.

FOREIGN PATENT DOCUMENTS

JP 2001-305887 A 11/2001
JP 2002-91174 A 3/2002
JP 2003-167456 A 6/2003

* cited by examiner

*Primary Examiner* — Susan Lee
(74) *Attorney, Agent, or Firm* — Sughrue Mion, PLLC

(57) ABSTRACT

An image forming apparatus includes an image carrier, a charging unit, an electrostatic latent image forming unit, a developing unit that contains a liquid developer containing a toner and a carrier solution and that develops an electrostatic latent image with the liquid developer to form a toner image on the surface of the image carrier, a transfer unit that transfers the toner image onto a recording medium, and a fixing unit that includes at least one pair of first and second rotating members that form a nip between the first and second rotating members. The following condition (A) is satisfied: the amount of the carrier solution on the surface of the toner image is about 0.7 g/m$^2$ or less during passing of the recording medium through the nip of the most-downstream pair of the at least one rotating-member pair in the leading direction of the recording medium.

4 Claims, 2 Drawing Sheets

IMAGE FORMING APPARATUS AND IMAGE FORMING METHOD

CROSS-REFERENCE TO RELATED APPLICATIONS

This application is based on and claims priority under 35 USC 119 from Japanese Patent Application No. 2013-129866 filed Jun. 20, 2013.

BACKGROUND (i) Technical Field

The present invention relates to an image forming apparatus and an image forming method.

(ii) Related Art

There are electrophotographic image forming apparatus and image forming method that employ a liquid developer containing a toner dispersed in a carrier solution.

SUMMARY

According to an aspect of the invention, there is provided an image forming apparatus including:

an image carrier;

a charging unit that charges a surface of the image carrier;

an electrostatic latent image forming unit that forms an electrostatic latent image on the charged surface of the image carrier;

a developing unit that contains a liquid developer containing a toner and a carrier solution containing a non-volatile oil and that develops the electrostatic latent image with the liquid developer to form a toner image on the surface of the image carrier;

a transfer unit that transfers the toner image onto a recording medium; and a fixing unit that includes at least one pair of first and second rotating members for fixing that form a nip between the first and second rotating members, and that applies heat and pressure to the recording medium having the transferred toner image and being passed through the nip to fix the toner image on the recording medium, wherein a condition (A) described below is satisfied:

condition (A): an amount of the carrier solution on a surface of the toner image is about 0.7 g/m$^2$ or less during passing of the recording medium through a nip of a most-downstream pair of the at least one rotating-member pair in a leading direction of the recording medium.

BRIEF DESCRIPTION OF THE DRAWINGS

Exemplary embodiments of the present invention will be described in detail based on the following figures, wherein.

DETAILED DESCRIPTION

Hereinafter, an image forming apparatus and an image forming method according to an exemplary embodiment of the invention will be described in detail.

Image Forming Apparatus and Image Forming Method

An image forming apparatus according to an exemplary embodiment includes an image carrier; a charging unit that charges a surface of the image carrier; an electrostatic latent image forming unit that forms an electrostatic latent image on the charged surface of the image carrier; a developing unit that contains a liquid developer containing a toner and a carrier solution containing a non-volatile oil and that develops the electrostatic latent image with the liquid developer to form a toner image on the surface of the image carrier; a transfer unit that transfers the toner image onto a recording medium; and a fixing unit that fixes the toner image on the recording medium.

The fixing unit includes at least one pair of first and second rotating members for fixing that form a nip between the first and second rotating members, and applies heat and pressure to the recording medium having the transferred toner image and being passed through the nip to fix the toner image on the recording medium.

In addition, the image forming apparatus satisfies a condition (A) described below.

An image forming method according to an exemplary embodiment includes charging a surface of an image carrier; forming an electrostatic latent image on the charged surface of the image carrier; developing the electrostatic latent image with a liquid developer containing a toner and a carrier solution containing a non-volatile oil, to form a toner image on the surface of the image carrier; transferring the toner image onto a recording medium; and fixing the toner image on the recording medium.

In the fixing of the toner image, heat and pressure are applied to the recording medium having the transferred toner image and being passed through a nip, with a fixing unit that includes at least one pair of first and second rotating members for fixing that form the nip between the first and second rotating members, to fix the toner image on the recording medium.

In addition, the image forming method satisfies the condition (A) described below.

Condition (A): the amount of the carrier solution on the surface of the toner image is 0.7 g/m$^2$ or less or about 0.7 g/m$^2$ or less during passing of the recording medium through the nip of the most-downstream pair (hereafter, also simply referred to as the "most-downstream nip") of the at least one rotating-member pair in the leading direction of the recording medium.

When an image is formed with a liquid developer, there are cases where the resultant image does not have sufficiently high gloss and an image of target quality is not obtained.

Figure 2:
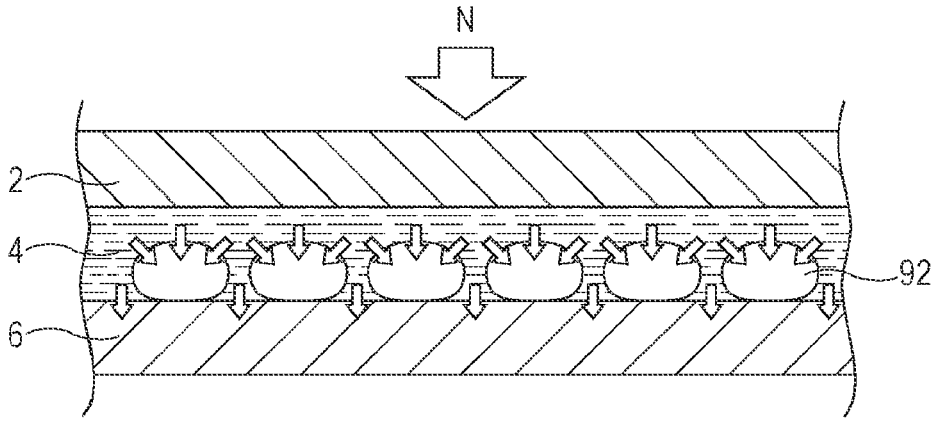
FIG. 2 is a schematic explanatory view illustrating the state of pressure applied to toner in the nip of a fixing unit of an existing image forming apparatus.

The mechanism of this phenomenon is not necessarily clear, but is probably as follows: During fixing, when a carrier solution in an amount larger than a specific amount is present on the surface of a toner layer passing through the nip of a pair of rotating members for fixing, as illustrated in FIG. 2, a pressure N generated by the nip between a first rotating member 2 and a second rotating member 6 for fixing is applied to a toner 92 not in one direction but in various directions via a carrier solution 4. As a result, the toner image is probably fixed so as to have a surface having not a smooth form but an irregular form. Thus, the image does not have sufficiently high gloss.

Figure 3:
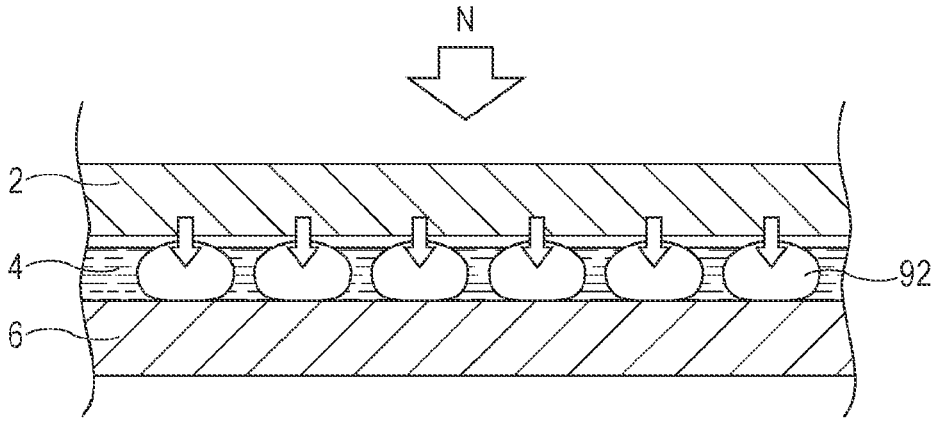
FIG. 3 is a schematic explanatory view illustrating the state of pressure applied to toner in the nip of a fixing unit of an image forming apparatus according to an exemplary embodiment.

In contrast, an image forming apparatus and an image forming method according to the exemplary embodiment satisfy the condition (A). When the amount of the carrier solution on the surface of the toner image is 0.7 g/m$^2$ or less or about 0.7 g/m$^2$ or less in the most-downstream nip, as illustrated in FIG. 3, portions of the toner 92 in the toner image are not immersed in the carrier solution 4; and, as a result, the pressure N generated by the nip is probably directly applied to the toner 92, that is, the pressure N generated by the nip is probably applied to the toner 92 in one direction. Thus, the toner image is probably fixed so as to have a surface having a smooth form. Thus, the image has sufficiently high gloss.

The amount of the carrier solution on the surface of the toner image during passing through the most-downstream nip is more preferably 0.4 $g/m^2$ or less or about 0.4 $g/m^2$ or less, still more preferably 0.2 $g/m^2$ or less or about 0.2 $g/m^2$ or less.

In the case where two pairs of the rotating members are provided, in addition to the most-downstream nip, in the nip of the second-most-downstream rotating-member pair in the leading direction of the recording medium, the condition is also preferably satisfied: the amount of the carrier solution on the surface of the toner image is 0.7 $g/m^2$ or less or about 0.7 $g/m^2$ or less, more preferably 0.4 $g/m^2$ or less or about 0.4 $g/m^2$ or less, still more preferably 0.2 $g/m^2$ or less or about 0.2 $g/m^2$ or less.

In the case where three pairs of the rotating members are provided, in addition to the most-downstream nip, in the nip of the second-most-downstream rotating-member pair in the leading direction of the recording medium, the condition is also preferably satisfied: the amount of the carrier solution on the surface of the toner image is 0.7 $g/m^2$ or less or about 0.7 $g/m^2$ or less, more preferably 0.4 $g/m^2$ or less or about 0.4 $g/m^2$ or less, still more preferably 0.2 $g/m^2$ or less or about 0.2 $g/m^2$ or less. Furthermore, in addition to the most-downstream nip and the second-most-downstream nip, in the nip of the third-most-downstream rotating-member pair in the leading direction of the recording medium, the condition is also preferably satisfied: the amount of the carrier solution on the surface of the toner image is 0.7 $g/m^2$ or less or about 0.7 $g/m^2$ or less, more preferably 0.4 $g/m^2$ or less or about 0.4 $g/m^2$ or less, still more preferably 0.2 $g/m^2$ or less or about 0.2 $g/m^2$ or less.

In summary, in the case where plural pairs of the rotating members are provided, in as many of the nips as possible among the nips of the pairs of rotating members starting from the most-downstream nip, the condition is preferably satisfied: the amount of the carrier solution on the surface of the toner image is 0.7 $g/m^2$ or less or about 0.7 $g/m^2$ or less, more preferably 0.4 $g/m^2$ or less or about 0.4 $g/m^2$ or less, still more preferably 0.2 $g/m^2$ or less or about 0.2 $g/m^2$ or less. Such a condition is preferably satisfied in all the nips of the plural pairs of rotating members.

The above-described toner may contain a release agent, and when the concentration of the release agent in the toner is represented by Y (% by mass) and the solid-content concentration of the toner image and the carrier solution immediately before application of heat to the toner image at a temperature equal to or higher than a melting temperature of the release agent is represented by Z (% by mass), a condition (B) described below may be satisfied:

condition (B): the amount of the carrier solution on the surface of the toner image is not less than about a ($g/m^2$) or a ($g/m^2$) represented by a formula (1) below during passing of the recording medium through the nip of the most-downstream pair of the at least one rotating-member pair in the leading direction of the recording medium, $$a=0.005/([0.01\times Z]\times[0.01\times Y]/\{1-[0.01\times Z]\times[1-0.01\times Y]\}) \quad \text{formula (1).}$$

When recording media having images formed with a liquid developer are left in the state of overlapping each other, the so-called document offset of migration of the image of one of the recording media onto the neighboring recording medium occurs is some cases. In order to suppress the occurrence of document offset, the toner may be made to contain a release agent and, during fixing, the release agent is melted and comes out of the toner to cover the surface of the image.

However, when the amount of the release agent on the surface of the toner image is excessively small in a nip for fixing, the release agent on the surface of the toner image may be in such a small amount that the occurrence of document offset is not suppressed.

In contrast, when an image forming apparatus and an image forming method according to the exemplary embodiment satisfy the condition (B), the occurrence of document offset is effectively suppressed.

This is probably because, when the condition (B) is satisfied, the amount of the release agent dissolved in the carrier solution on the surface of the toner image in the most-downstream nip is 0.005 $g/m^2$ or more and, as a result, an appropriate amount of the release agent is present on the surface of the toner image.

Method of Measuring the Amount of Carrier Solution on the Surface of Toner Image During Passing Through Nip A recording medium having a toner image is passed through the nip of a pair of rotating members. From the mass of the toner image and the recording medium per unit area ($g/m^2$) before the passing, the mass of the toner image and the recording medium per unit area ($g/m^2$) after the passing is subtracted. The resultant amount is doubled and defined as the amount of the carrier solution on the surface of the toner image during passing through the nip.

The reason for doubling the amount is as follows: in the nip of a pair of rotating members including a first rotating member (for example, in an image forming apparatus 100 illustrated in FIG. 1, a heating roller 80*a* equipped with a blade 72*b* and a carrier-solution collecting unit 74*b*) having a function of removing a carrier solution (collecting about a half amount of the carrier solution), due to division within the carrier solution, about a half amount of the carrier solution on the surface of the toner image probably adheres to the rotating member (first rotating member) that comes into contact with the toner image. Alternatively, in the nip of a pair of rotating members including a first rotating member (for example, a fixing roller not equipped with a mechanism of collecting the carrier solution, such as a blade) not having a function of removing a carrier solution (collecting about a half amount of the carrier solution), the amount of the carrier solution adhering to the surface of the rotating member (first rotating member) and the amount of the carrier solution on the surface of the toner image probably achieve a state of equilibrium. The amount of the carrier solution during passing through the nip denotes the total amount of the carrier solution present on the surface of the toner image prior to passing through the nip and the amount of the carrier solution present on the surface of the first rotating member prior to entry into the nip. Due to division within the carrier solution, about a half amount of the carrier solution probably again adheres to the first rotating member that comes into contact with the toner image.

The mass of the toner image and the recording medium is measured by cutting out a sample having an area and the mass of the sample is measured. In the measurement method, it is not necessary that recording medium samples before and after passing through a nip are cut out from the same recording medium. For example, in the case of a sheet-fed image forming apparatus, a recording medium sample before passing through a nip and a recording medium sample after passing through the nip may be separately collected and these samples may be compared with each other by the above-described method.

The term "the amount of the carrier solution on the surface of the toner image" denotes, in the case where a release agent is dissolved in the carrier solution, the amount of the carrier solution containing the dissolved release agent.

Concentration Y of the Release Agent in the Toner

The concentration Y of the release agent in the toner is measured by the following method. The liquid developer contained in the developing unit is extracted and the carrier solution is separated to provide the toner. This separation of the toner and the carrier solution is performed by subjecting the liquid developer to filtration under a reduced pressure to remove a large amount of the carrier solution contained in the developer. A volatile oil (carrier solution) is removed by drying the developer having been subjected to filtration under a reduced pressure. In the exemplary embodiment, a non-volatile oil is at least contained as the carrier solution. Regarding this non-volatile oil, the filtrated developer is mixed with a volatile solvent that allows dispersion of the toner therein and is miscible with the carrier solution, so that the non-volatile oil (carrier solution) remaining in the developer is extracted to the volatile solvent. At this time, the amount of the volatile solvent used is ten or more times the amount of the filtrated developer so that the carrier solution is sufficiently removed. After that, the developer mixed with a volatile oil is again subjected to filtration under a reduced pressure; and the volatile oil contained in the filtrated developer is dried to provide a toner from which the carrier solution has been removed.

Subsequently, the concentration (% by mass) of the release agent in the toner is calculated by the following method. Specifically, an amount of the toner is placed in a container (container A) having a known mass. The mass $W_0$ of the toner in the container A is measured. In the container A, a sufficiently large amount (specifically, a mass that is 100 or more times the mass $W_0$ of the toner) of a solvent (solvent B) is placed in the container A. In the solvent B, the release agent alone in the components of the toner dissolves at a temperature equal to or higher than the temperature at which a binder resin and the release agent are melted. Here, the toner is entirely immersed in the solvent B. After that, the solvent is kept at a temperature that is sufficiently higher (specifically by 20° C. or more) than the temperature at which the binder resin and the release agent are melted for a long period of time (specifically 10 or more minutes) so that the release agent contained in the toner is dissolved in the solvent B. As described above, by keeping the solvent B at a temperature that is 20° C. or more higher than the temperature at which the binder resin and the release agent are melted for 10 or more minutes, substantially the entirety of the release agent in the toner is dissolved in the solvent B. After that, from the container A, the solvent B containing the release agent is removed as much as possible by a method that does not decrease the amount of the melted toner in the container A (for example, a method of suctioning the solvent B alone). After that, in the case where the solvent B is volatile, a sufficiently large amount of the solvent B (specifically, a mass that is 10 or more times the mass of the toner and the solvent B left in the container A) is further placed in the container A to dilute the solvent B containing the release agent. Alternatively, in the case where the solvent B is non-volatile, a sufficiently large amount of a volatile solvent C (specifically, a mass that is 10 or more times the mass of the toner and the solvent B left in the container A) that is miscible with the solvent B is placed in the container A to mix the solvent B containing the release agent with the solvent C. After that, from the container A, the solvent B or the solvent C is removed as much as possible by a method that does not decrease the amount of the toner in the container A (for example, a method of suctioning the solvent B alone). Finally, the volatile solvent B or C left in the container A is evaporated to provide a toner from which the release agent has been removed. The mass $W_1$ of this toner is measured. From the following formula, the concentration Y (% by mass) of the release agent in the toner is calculated.

$$Y=100\times(W_0-W_1)/W_0$$

Solid-Content Concentration Z

The "solid-content concentration Z of the toner image and the carrier solution immediately before application of heat to the toner image at a temperature equal to or higher than a melting temperature of the release agent" will be described. In the exemplary embodiment, in the fixing unit (fixing step), at least one pair of rotating members is used to apply heat to the toner image. At least one of the at least one pair of rotating members applies heat at a temperature equal to or higher than the melting temperature of the release agent. In the case where plural pairs of rotating members are provided, two or more pairs of rotating members may apply heat at a temperature equal to or higher than the melting temperature of the release agent. Furthermore, in the case where a heating unit (heating step) that applies heat to the toner image is provided (for example, a heating device 60 in the image forming apparatus 100 illustrated in FIG. 1 described below) prior to the fixing unit (fixing step), the heating unit (heating step) may apply heat at a temperature equal to or higher than the melting temperature of the release agent. Regarding such applications of heat, the solid-content concentration per unit area in the total mass of the toner image and the carrier solution immediately before the first application of heat at a temperature equal to or higher than the melting temperature of the release agent is defined as Z.

In the exemplary embodiment, as described below, the carrier solution on the toner image may be removed with, for example, a first rotating member for fixing, a carrier-solution removal member that may be provided at an upstream position of a pair of rotating members in the leading direction of the recording medium, or a carrier-solution removal member that may be provided on the surface of the image carrier or on the surface of the intermediate transfer body. Thus, the term "immediately before" in the solid-content concentration Z denotes a stage at which the toner image is to be heated at a temperature equal to or higher than a melting temperature of the release agent and the carrier solution is no longer removed.

The temperature at which the release agent and the binder resin are melted (that is, the melting temperature of the release agent and the binder resin) is measured with a DSC measurement apparatus (differential scanning calorimeter DSC-7, manufactured by PerkinElmer, Inc.) in compliance with ASTMD 3418-8. In the detector of the apparatus, temperature correction is performed with the melting temperature of indium and zinc and calorimetric correction is performed with the heat of fusion of indium. A sample is measured with an aluminum pan and an empty pan is set as a reference. The measurement is performed at a heating rate of 10° C./min.

Here, the melting temperature denotes a temperature corresponding to the top of the endothermic peak (main maximum peak) obtained by performing the above-described measurement.

Method of Adjusting the Amount of the Carrier Solution

In the exemplary embodiment, as described below, in the fixing unit (fixing step), at least one pair of rotating members is provided and, in the at least one pair of rotating members, a first rotating member coming into contact with the toner image may have a function of removing the carrier solution (for example, in the image forming apparatus 100 illustrated in FIG. 1, the heating roller (first rotating member) 80*a* may be equipped with the blade 72*b* and the carrier-solution collecting unit 74*b*). A carrier-solution removal unit (for example, in the image forming apparatus 100 illustrated in FIG. 1, a carrier-solution removal roller pair 70) may be provided at an upstream position of the fixing unit (fixing step) in the leading direction of the recording medium. Another carrier-solution removal unit may be provided on the surface of the image carrier or on the surface of the intermediate transfer body.

For example, by adjusting the amount of the carrier solution removed by the function of removing the carrier solution or the carrier-solution removal unit or by adjusting the amount of the carrier solution applied to the surface of the image carrier by the developing unit (developing step), the amount of the carrier solution on the surface of the toner image during passing through the nip of at least one pair of rotating members in the fixing unit (fixing step) is adjusted.

Configurations of Image Forming Apparatus and Image Forming Method

As described above, an image forming apparatus according to the exemplary embodiment includes an image carrier, a charging unit, an electrostatic latent image forming unit, a developing unit, a transfer unit, and a fixing unit.

An image forming method according to the exemplary embodiment includes a charging step, an electrostatic latent image formation step, a developing step, a transferring step, and a fixing step.

Hereinafter, the image forming apparatus according to the exemplary embodiment will be described in detail with reference to a drawing. In addition, an image forming method employing this image forming apparatus will also be described.

Figure 1:
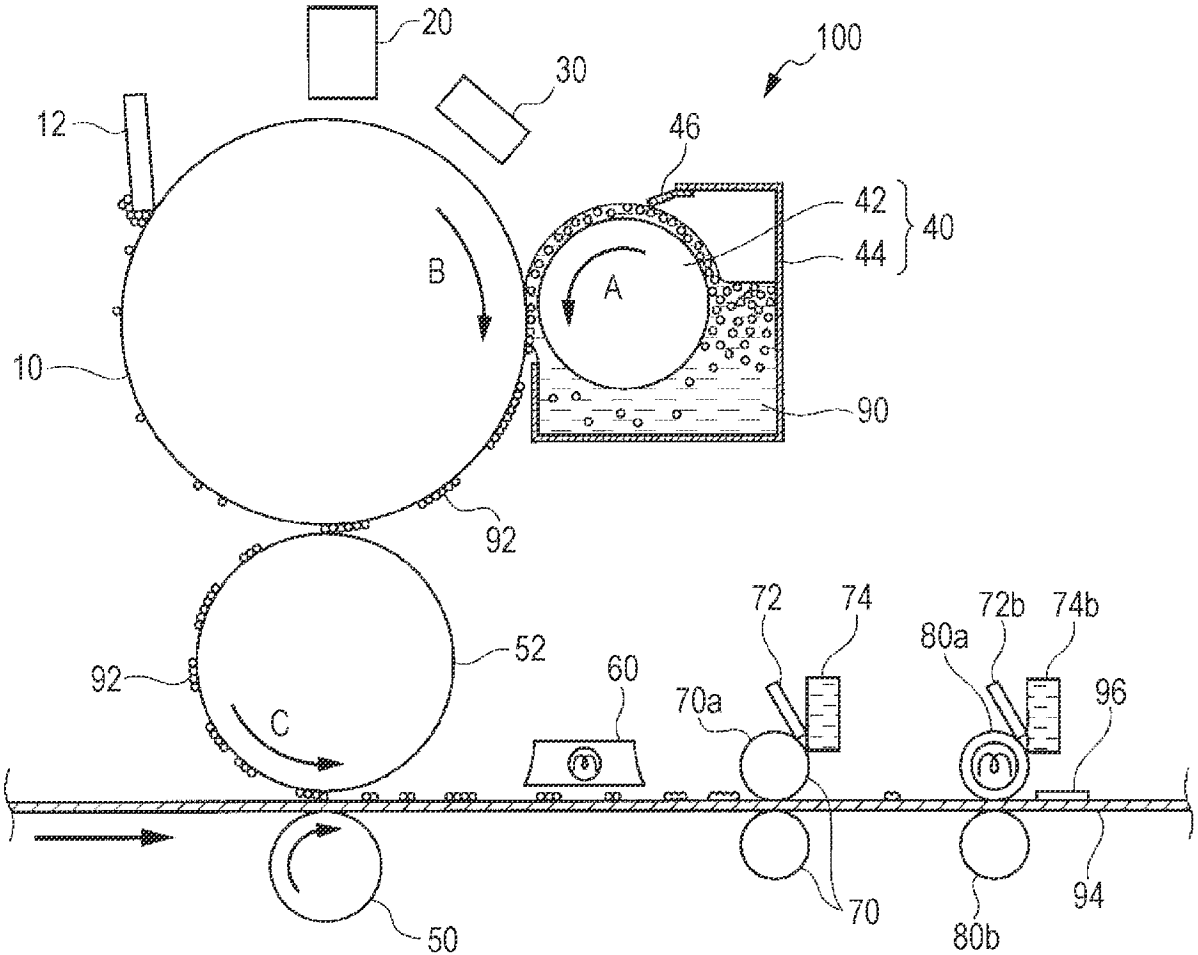
FIG. 1 is a schematic configuration view illustrating an example of an image forming apparatus according to an exemplary embodiment.

FIG. 1 is a schematic configuration view illustrating an example of an image forming apparatus according to the exemplary embodiment.

The image forming apparatus 100 includes a photoconductor (image carrier) 10, a charging device (charging unit) 20, an exposure device (electrostatic latent image forming unit) 30, a developing device (developing unit) 40, an intermediate transfer body 52, a photoconductor cleaner 12, a transfer roller (transfer unit) 50, a non-contact heating device (heating unit) 60, a carrier-solution removal roller pair (carrier-solution removal unit) 70, and a fixing unit including a heat-press roller pair (pair of rotating members for fixing) including a heating roller (first rotating member) 80*a* and a pressing roller (second rotating member) 80*b*.

The photoconductor 10 has a cylindrical shape. The photoconductor 10 is surrounded by the charging device 20, the exposure device 30, the developing device 40, the intermediate transfer body 52, and the photoconductor cleaner 12 that are disposed in this order.

The transfer roller 50 is disposed at a position where a toner image 92 having been transferred onto the intermediate transfer body 52 is transferred onto a paper sheet (recording medium) 94.

Furthermore, in the leading direction of the paper sheet 94, the non-contact heating device 60 is disposed downstream with respect to the transfer roller 50; the carrier-solution removal roller pair 70 is disposed downstream with respect to the heating device 60; and the heat-press roller pair including the heating roller 80*a* and the pressing roller 80*b* is disposed downstream with respect to the carrier-solution removal roller pair 70. The heating roller 80*a* is equipped with the blade 72*b* that is in contact with the surface of the heating roller 80*a* to remove the carrier solution adhering to the surface, and a carrier-solution collecting unit 74*b* that collects the removed carrier solution. Thus, the function of removing the carrier solution is provided.

This is not illustrated in FIG. 1, but a carrier-solution removal unit (for example, a carrier-solution removal roller) may be disposed so as to be in contact with a portion of the surface of the photoconductor 10, the portion being positioned downstream with respect to the developing device 40 and upstream with respect to the intermediate transfer body 52. In addition, a carrier-solution removal unit (for example, a carrier-solution removal roller) may be disposed so as to be in contact with a portion of the surface of the intermediate transfer body 52, the portion being positioned downstream with respect to the photoconductor 10 and upstream with respect to the transfer roller 50.

Hereinafter, operations of the image forming apparatus 100 will be simply described.

The charging device 20 charges the surface of the photoconductor 10 to the predetermined potential.

After that, the charged surface of the photoconductor 10 is exposed by the exposure device 30 with, for example, a laser beam in accordance with image signals. Thus, an electrostatic latent image is formed.

Subsequently, the electrostatic latent image formed on the surface of the photoconductor 10 is developed by the developing device 40. This development will be specifically described.

Here, the developing device 40 includes a developing roller 42, a developer container 44, and a regulation member 46. The developing roller 42 is disposed such that it is partially immersed in a liquid developer 90 contained in the developer container 44. In the liquid developer 90, toner is dispersed. For example, the liquid developer 90 may be stirred with a stirring member disposed in the developer container 44. The liquid developer 90 supplied on the surface of the developing roller 42 is transported, through rotation of the developing roller 42 in the direction of arrow A, toward the photoconductor 10 such that the amount of the liquid developer 90 is limited to a predetermined amount with the regulation member 46. The liquid developer 90 is supplied to the electrostatic latent image at a position where the developing roller 42 and the photoconductor 10 face (or come into contact with) each other. As a result, the electrostatic latent image is developed to provide a toner image 92. At this time, the carrier solution is present around the toner image 92.

The thus-obtained toner image 92 together with the carrier solution is transported with the photoconductor 10 rotated in the direction of arrow B and transferred onto a paper sheet (recording medium) 94. In the exemplary embodiment, prior to the transfer onto the paper sheet 94, the toner image 92 is temporarily transferred onto the intermediate transfer body 52. At this time, a peripheral velocity difference may be set between the photoconductor 10 and the intermediate transfer body 52.

Subsequently, the toner image 92 transported with the intermediate transfer body 52 in the direction of arrow C is transferred together with the carrier solution onto the paper sheet 94 at a position where the intermediate transfer body 52 comes into contact with the transfer roller 50.

The toner image 92 having been transferred onto the paper sheet 94 is turned into a fixed image by the following procedures.

In the leading direction of the paper sheet 94, the non-contact heating device 60 is disposed downstream with respect to the transfer roller 50. In this configuration, preheating of the toner image 92 is performed. The non-contact heating device 60 is used to heat the toner image 92.

The heating temperature of the heating device 60 may be not less than a temperature at which the release agent in the toner is melted or may be less than the temperature at which the release agent is melted. Specifically, the heating is desirably performed at a temperature at which the binder resin in the toner is melted. The heating time is determined in consideration of the separation status between the toner image and the carrier solution and in accordance with the heating temperature, the length of the heating device 60 in the leading direction of the paper sheet 94, and the process speed.

In the exemplary embodiment, the non-contact heating device 60 is a plate-shaped heating device that contains a heater within a plate-shaped body having a metal surface.

As to the heater used in the heating device 60, as in the exemplary embodiment illustrated in FIG. 1, for example, in the case where the toner image 92 (heating target) is heated in non-contact manner on the toner-image side, a halogen heater, a hot-air dryer, or the like may be used. An air blower that blows hot air, an irradiation device that radiates an infrared beam, or the like may be used.

Alternatively, an exemplary embodiment may be employed in which heating is performed through the backside of the toner image 92 (heating target), that is, through a surface of the paper sheet 94 on which the toner image is not formed. In this case, the heater used for the heating device 60 may be a heating plate, a heating roller, or the like disposed so as to be in contact with the backside.

Alternatively, both of the front and back sides of the toner image 92 may be heated.

The toner image 92 having been preheated as described above is supplied to the carrier-solution removal roller pair 70, which is disposed downstream with respect to the heating device 60 in the leading direction of the paper sheet 94. An exemplary embodiment of the carrier-solution removal roller pair 70 is a roller pair having elastic layers in the surfaces. The carrier-solution removal roller pair 70 forms a nip. When the paper sheet 94 is passed through the nip of the carrier-solution removal roller pair 70, the carrier solution having been separated from the toner image 92 is transferred onto a first roller 70*a*, which is disposed on the toner image side. In this manner, the carrier solution is removed from the toner image 92.

In the exemplary embodiment, specifically, the roller pair includes elastic layers formed of heat-resistant silicone rubber and PFA layers as the outermost release layers.

The carrier-solution removal unit is not limited to the roller-pair structure and may be a unit that removes the carrier solution having been separated on a toner image. For example, the carrier-solution removal unit may be a belt-shaped member that is brought into contact with the carrier solution on the surface of the toner image 92.

The first roller 70*a* in the carrier-solution removal roller pair 70 may have a configuration having no elastic layer (for example, a metal roller).

The carrier-solution removal roller pair 70 may have a configuration in which rollers are disposed with a gap therebetween and without forming a nip. In this configuration having no nip, the first roller 70*a* comes into contact with only the carrier solution having been separated from the toner image 92. Accordingly, the first roller 70*a* does not apply an external stress to the toner image 92 and does not disturb the toner image 92.

The first roller 70*a* in the carrier-solution removal roller pair 70 is equipped with the blade 72 disposed so as to be in contact with the first roller 70*a*. The first roller 70*a* is also equipped with the carrier-solution collecting unit 74. The carrier solution collected onto the surface of the first roller 70*a* is collected with the blade 72 and placed in the carrier-solution collecting unit 74.

The carrier solution collected in the carrier-solution collecting unit 74 may be transported through a pipe (not shown) to a carrier-solution supply unit (not shown) and used again.

In the exemplary embodiment illustrated in FIG. 1, a single carrier-solution removal roller pair 70 described above is disposed. However, the number of the carrier-solution removal roller pair 70 may be determined in accordance with, for example, the carrier-solution collection capability or the size of the apparatus. Plural carrier-solution removal roller pairs may be disposed. A heating unit may be disposed within the carrier-solution removal roller pair 70. Such a heating unit promotes melting of the toner layer so that separation between the toner layer and the carrier solution is promoted to enhance the carrier-solution removal capability.

Plural carrier-solution removal units having different configurations may be disposed.

As described above, after the carrier solution separated on the toner image is removed, the toner image is heated and pressed with a heat-press roller pair including the heating roller 80*a* and the pressing roller 80*b*. Thus, the toner image is fixed on the paper sheet 94.

Each of the heating roller 80*a* and the pressing roller 80*b* includes a metal roller, an elastic rubber layer, and a release layer for releasing the toner. The heating roller 80*a* and the pressing roller 80*b* nip the paper sheet 94 therebetween with a pressing mechanism (not shown) such that predetermined pressure and nip width are achieved. In addition, at least one of the rollers of the heat-press roller pair (in FIG. 1, the heating roller 80*a*) includes a heater. Alternatively, this heater may be disposed in the pressing roller 80*b*. Such heaters may be disposed in both of the rollers of the heat-press roller pair.

In the exemplary embodiment illustrated in FIG. 1, a single heat-press roller pair described above is disposed. However, the number of the heat-press roller pair may be determined in accordance with, for example, the fixing capability or the size of the apparatus. Plural heat-press roller pairs may be disposed. For example, three heat-press roller pairs that are the most-upstream roller pair, a midstream roller pair, and the most-downstream roller pair may be sequentially disposed from the upstream side in the leading direction of the paper sheet 94 such that each roller pair forms a nip that nips the paper sheet 94.

The heating roller 80*a* in the heat-press roller pair is equipped with the blade 72*b* that comes into contact with the surface of the heating roller 80*a* and further equipped with the carrier-solution collecting unit 74*b*. The carrier solution collected onto the surface of the heating roller 80*a* is collected with the blade 72*b* and placed in the carrier-solution collecting unit 74*b*.

The carrier solution collected in the carrier-solution collecting unit 74*b* may be transported through a pipe (not shown) to a carrier-solution supply unit (not shown) and used again.

In the exemplary embodiment, the condition (A) is satisfied at least in the nip of the most-downstream roller pair including the heating roller 80*a* and the pressing roller 80*b*.

In the case where two or more heat-press roller pairs are provided, in addition to the most-downstream roller pair, in the nip of the second-most-downstream roller pair in the leading direction of the paper sheet 94 (in an exemplary embodiment where three heat-press roller pairs described above are provided, the midstream roller pair), the condition is also preferably satisfied: the amount of the carrier solution on the surface of the toner image is 0.7 g/m$^2$ or less or about 0.7 g/m$^2$ or less. Furthermore, in the nip of the third-most-downstream roller pair (in an exemplary embodiment where three heat-press roller pairs described above are provided, the most-upstream roller pair), the condition is also preferably satisfied: the amount of the carrier solution on the surface of the toner image is 0.7 g/m$^2$ or less or about 0.7 g/m$^2$ or less. In summary, in the case where plural heat-press roller pairs (pairs of rotating members) are provided, in as many of the nips as possible among the nips of the heat-press roller pairs (pairs of rotating members) starting from the most-downstream nip in the leading direction of the paper sheet 94, the condition is preferably satisfied: the amount of the carrier solution on the surface of the toner image is 0.7 g/m$^2$ or less or about 0.7 g/m$^2$ or less.

The first rotating member and the second rotating member for fixing are not limited to the form of heat-press roller pairs and may be, for example, a device in which a heating roller and a pressing belt are combined, a device in which a pressing roller and a heating belt are combined, or a device in which a heating belt and a pressing belt are combined.

Regarding the heating temperature of heat-press roller pairs, the heating temperature of at least one heat-press roller pair may be not less than a temperature at which the release agent and the binder resin in the toner are melted.

Specifically, the heating temperature of such a heat-press roller pair is desirably in the range of 110° C. or more and 150° C. or less, more desirably in the range of 120° C. or more and 140° C. or less.

The pressure applied by the heat-press roller pair is desirably 1.5 kg/cm$^2$ or more and 5 kg/cm$^2$ or less, more desirably 2 kg/cm$^2$ or more and 3.5 kg/cm$^2$ or less.

At the position of the heat-press roller pair, the toner image is fixed on the paper sheet 94 to form a fixed image 96. After that, the paper sheet 94 is transported to the exit port (not shown).

On the other hand, in the photoconductor 10 from which the toner image 92 has been transferred onto the intermediate transfer body 52, toner particles remaining after the transfer are transported to a position where the photoconductor 10 comes in contact with the photoconductor cleaner 12. The toner particles are collected with the photoconductor cleaner 12. However, in the case where the transfer efficiency is almost 100% and the generation of remaining toner is suppressed, the photoconductor cleaner 12 may be omitted.

The image forming apparatus 100 may be further equipped with a static eliminator (not shown) that destaticizes the surface of the photoconductor 10 after transfer and before the next charging.

In the image forming apparatus 100, all of the charging device 20, the exposure device 30, the developing device 40, the intermediate transfer body 52, the transfer roller 50, the photoconductor cleaner 12, the heating device 60, the carrier-solution removal roller pair 70, and a heat-press roller pair are operated in synchronization with the rotation rate of the photoconductor 10.

In the image forming apparatus illustrated in FIG. 1, a configuration may be employed in which a liquid developer is supplied from a liquid-developer cartridge (not shown) detachably attached to the image forming apparatus, to the developer container 44.

The developing device 40 in FIG. 1 may have a configuration of a process cartridge detachably attached to the image forming apparatus 100.

An image forming apparatus according to the exemplary embodiment, which is not limited to the above-described configurations, employs the above-described liquid developer and performs a fixing step. For example, the image forming apparatus may be a tandem-type image forming apparatus in which photoconductors for different development colors are disposed side by side.

Liquid Developer

A liquid developer used in the exemplary embodiment contains a toner and a carrier solution containing a non-volatile oil.

Hereinafter, components of the liquid developer used in the exemplary embodiment (toner, carrier solution, and other components) will be described in detail.

Toner

The toner is not particularly limited and may contain, for example, a binder resin, a coloring agent, a release agent, and other additive components.

Binder Resin

Although the binder resin is not particularly limited, it is desirably synthesized by a polyaddition reaction or a polycondensation reaction in view of low-temperature fixability and storage stability. Specific examples of the binder resin include polyester resins, polyurethane resins, epoxy resins, and polyol resins. Of these, polyester resins are desirably used in view of miscibility with a crystalline resin used in combination and the capability of containing the release agent.

Regarding the binder resin, use of a crystalline resin and an amorphous resin in combination is desirable in view of obtaining a sharp melting characteristic during fixing.

The term "crystalline resin" denotes a resin that has not a stepped endothermic change but a clear endothermic peak in differential scanning calorimetry (DSC); this resin is a crystalline resin having a weight-average molecular weight of at least more than 5000; in general, this resin is a crystalline resin having a weight-average molecular weight of 10000 or more.

The term "amorphous resin" denotes a resin that has a stepped endothermic change corresponding to glass transition but does not have a clear endothermic peak corresponding to the melting temperature in differential scanning calorimetry (DSC).

Crystalline Resin

The crystalline resin has a melting temperature and hence undergoes a large decrease in viscosity at a specific temperature. Thus, in the toner being heated during fixing, the temperature difference between the temperature at which crystalline resin molecules are thermally activated and the fixing temperature region may be made small. Accordingly, the low-temperature fixability may be further enhanced. The content of the crystalline resin in toner particles is desirably in the range of 1% by mass or more and 10% by mass or less, more desirably in the range of 2% by mass or more and 8% by mass or less.

The crystalline resin desirably has a melting temperature in the range of 45° C. or more and 110° C. or less to ensure low-temperature fixability and toner storage stability. The melting temperature is more desirably in the range of 50° C. or more and 100° C. or less, still more desirably in the range of 55° C. or more and 90° C. or less. The melting temperature is determined by a method in compliance with ASTMD 3418-8.

The crystalline resin desirably has a number-average molecular weight (Mn) of 2000 or more, more desirably 4000 or more.

The crystalline resin is desirably a crystalline resin having a weight-average molecular weight of more than 5000. Specific examples of this crystalline resin include crystalline polyester resins and crystalline vinyl resins. In particular, crystalline polyester resins are desirable, more desirably, aliphatic crystalline polyester resins having an appropriate melting temperature.

Examples of crystalline vinyl resins include vinyl resins using a (meth)acrylic ester of a long-chain alkyl or alkenyl such as amyl (meth)acrylate, hexyl (meth)acrylate, heptyl (meth)acrylate, octyl (meth)acrylate, nonyl (meth)acrylate, decyl (meth)acrylate, undecyl (meth)acrylate, tridecyl (meth) acrylate, myristyl (meth)acrylate, cetyl (meth)acrylate, stearyl (meth)acrylate, oleyl (meth)acrylate, or behenyl (meth)acrylate. In this Specification, the expression "(meth) acryl" encompasses "acryl" and "methacryl".

On the other hand, the crystalline polyester resin is synthesized from, for example, a carboxylic acid (dicarboxylic acid) component and an alcohol (diol) component. Hereinafter, the carboxylic acid component and the alcohol component will be described further in detail. Note that, in the exemplary embodiment, a copolymer resin containing 50% by mass or less of another component with respect to the main chain of the crystalline polyester resin is also encompassed within the crystalline polyester resin.

The carboxylic acid component is desirably an aliphatic dicarboxylic acid, in particular, desirably a straight-chain carboxylic acid. Non-limiting examples of the carboxylic acid component include oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, 1,18-octadecanedicarboxylic acid, and lower alkyl esters and anhydrides of the foregoing.

In addition to the aliphatic dicarboxylic acid component, the carboxylic acid component desirably contains another constitutional component such as a dicarboxylic acid component having a double bond or a dicarboxylic acid component having a sulfonic group. The dicarboxylic acid component having a double bond may be, for example, a constitutional component derived from a dicarboxylic acid having a double bond or a constitutional component derived from a lower alkyl ester or anhydride of a dicarboxylic acid having a double bond. The dicarboxylic acid component having a sulfonic group may be, for example, a constitutional component derived from a dicarboxylic acid having a sulfonic group or a constitutional component derived from a lower alkyl ester or anhydride of a dicarboxylic acid having a sulfonic group.

The dicarboxylic acid having a double bond is desirably a carboxylic acid that allows cross-linking of the entire resin by using the double bond. Non-limiting examples of such a dicarboxylic acid include fumaric acid, maleic acid, 3-hexenedioic acid, 3-octenedioic acid, and lower alkyl esters and anhydrides of the foregoing. Of these, fumaric acid, maleic acid, and the like are desirable.

The dicarboxylic acid component having a sulfonic group is effective because it allows enhancement of dispersion of a coloring agent such as a pigment. When a sulfonic group is present in the case of forming particles through emulsification or suspension of the entire resin in water, as described below, the emulsification or suspension may be achieved without using a surfactant. Non-limiting examples of such a dicarboxylic acid component having a sulfonic group include sodium 2-sulfoterephthalate, sodium 5-sulfoisophthalate, sodium sulfosuccinate, and lower alkyl esters and anhydrides of the foregoing. Of these, sodium 5-sulfoisophthalate and the like are desirable.

The content of such a carboxylic acid component other than the aliphatic dicarboxylic acid component (a dicarboxylic acid component having a double bond or a dicarboxylic acid component having a sulfonic group) in the carboxylic acid components is desirably 1 constitutional mol % or more and 20 constitutional mol % or less, more desirably 2 constitutional mol % or more and 10 constitutional mol % or less.

Note that, in the exemplary embodiment, the term "constitutional mol %" denotes percentage in which each constitutional component (carboxylic acid component and alcohol component) in a polyester resin is defined as one unit (mole).

On the other hand, the alcohol constitutional component is desirably an aliphatic diol. Non-limiting examples thereof include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,20-eicosanediol.

In the alcohol component, the content of an aliphatic diol component is desirably 80 or more constitutional mol % and the alcohol component may also contain another component. In the alcohol component, the content of an aliphatic diol component is more desirably 90 or more constitutional mol %.

Examples of the other component include constitutional components such as a diol component having a double bond and a diol component having a sulfonic group.

Examples of the diol component having a double bond include 2-butene-1,4-diol, 3-butene-1,6-diol, and 4-butene-1,8-diol. Examples of the diol component having a sulfonic group include 1,4-dihydroxy-2-sulfonic acid benzene sodium salt, 1,3-dihydroxymethyl-5-sulfonic acid benzene sodium salt, and 2-sulfo-1,4-butanediol sodium salt.

In the case where such a component other than the straight-chain aliphatic diol component (a diol component having a double bond or a diol component having a sulfonic group) is added, the content of this component in the alcohol component is desirably 1 constitutional mol % or more and 20 constitutional mol % or less, more desirably 2 constitutional mol % or more and 10 constitutional mol % or less.

The method of producing the crystalline polyester resin is not particularly limited. The crystalline polyester resin is produced by a standard polyester polymerization method causing a reaction between a carboxylic acid component and an alcohol component, such as direct polycondensation or a transesterification method. An appropriate method is selected in accordance with the type of the monomer. The molar ratio (acid component/alcohol component) during the reaction between the acid component and the alcohol component varies depending on the reaction conditions or the like and hence is not limited; however, in general, the molar ratio is 1/1.

The crystalline polyester resin is produced at a polymerization temperature of 180° C. or more and 230° C. or less. This reaction is caused to proceed while water or alcohol generated by condensation is removed. This reaction may be performed while the reaction system is kept at a reduced pressure. When monomers are not dissolved or mixed together at the reaction temperature, the monomers may be dissolved by being mixed with a high-boiling-point solvent serving as a solubilizing agent. The polycondensation reaction is caused to proceed while the solubilizing agent is distilled off. In the case where a monomer having low miscibility is used in a copolymerization reaction, this monomer having low miscibility and a carboxylic acid component or an alcohol component for polycondensation may be subjected to condensation and the resultant condensation product and a main component may be subjected to polycondensation.

Examples of a catalyst that may be used in the production of a crystalline polyester resin include compounds of alkali metals such as sodium and lithium; compounds of alkaline-earth metals such as magnesium and calcium; compounds of metals such as zinc, manganese, antimony, titanium, tin, zirconium, and germanium; phosphorous acid compounds, phosphoric acid compounds, and amine compounds. Specific examples thereof are as follows.

Examples of the compounds include sodium acetate, sodium carbonate, lithium acetate, calcium acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenyl antimony, tributyl antimony, tin formate, tin oxalate, tetraphenyl tin, dibutyltin dichloride, dibutyltin oxide, diphenyltin oxide, zirconium tetrabutoxide, zirconium naphthenate, zirconyl carbonate, zirconyl acetate, zirconyl stearate, zirconyl octylate, germanium oxide, triphenyl phosphite, tris(2,4-di-t-butylphenyl)phosphite, ethyltriphenylphosphonium bromide, triethylamine, and triphenylamine.

For the purpose of adjusting, for example, the melting temperature or molecular weight of the crystalline resin, in addition to the polymerizable monomers, a compound having, for example, an alkyl group having a shorter chain, an alkenyl group having a shorter chain, or an aromatic ring may be used.

Specific examples of such a compound are as follows. Specific examples of a dicarboxylic acid include alkyl dicarboxylic acids such as succinic acid, malonic acid, and oxalic acid; aromatic dicarboxylic acids such as phthalic acid, isophthalic acid, terephthalic acid, homophthalic acid, 4,4'-bi-benzoic acid, 2,6-naphthalenedicarboxylic acid, and 1,4-naphthalenedicarboxylic acid; and nitrogen-containing aromatic dicarboxylic acids such as dipicolinic acid, dinicotinic acid, quinolinic acid, and 2,3-pyrazine dicarboxylic acid. Specific examples of a diol include short-chain-alkyl diols such as succinic acid, malonic acid, acetone dicarboxylic acid, and diglycolic acid. Specific examples of a short-chain-alkyl vinyl polymerizable monomer include short-chain-alkyl/alkenyl (meth)acrylates such as methyl (meth)acrylate, ethyl (meth)acrylate, propyl (meth)acrylate, and butyl (meth)acrylate; vinyl nitriles such as acrylonitrile and methacrylonitrile; vinyl ethers such as vinyl methyl ether and vinyl isobutyl ether; ketones such as vinyl methyl ketone, vinyl ethyl ketone, and vinyl isopropenyl ketone; and olefins such as ethylene, propylene, butadiene, and isoprene. These polymerizable monomers may be used alone or in combination of two or more thereof.

A crystalline polyester resin serving as the crystalline resin desirably has a melting temperature of 50° C. or more and 100° C. or less in view of toner storability and low-temperature fixability, more desirably 55° C. or more and 90° C. or less, and still more desirably 60° C. or more and 85° C. or less.

Amorphous Resin

The amorphous resin may be a publicly known amorphous resin used for toner. For example, styrene-acrylic resins may be used. Amorphous polyester resins are desirably used.

Such an amorphous polyester resin desirably has a glass transition temperature (Tg) in the range of 50° C. or more and 80° C. or less, more desirably in the range of 55° C. or more and 65° C. or less. The amorphous polyester resin desirably has a weight-average molecular weight in the range of 8000 or more and 30000 or less, more desirably in the range of 8000 or more and 16000 or less. In addition, a third component may be used for copolymerization.

The amorphous polyester resin desirably has the same alcohol component or carboxylic acid component as the crystalline polyester compound to be used in combination with the amorphous polyester resin, for the purpose of enhancing miscibility.

The method of producing the amorphous polyester resin is not particularly limited. The amorphous polyester resin may be produced by the above-described standard polyester polymerization method.

A carboxylic acid component used for the synthesis of the amorphous polyester resin may be selected from the various dicarboxylic acids mentioned in terms of the crystalline polyester resin. An alcohol component may also be selected from various diols used for the synthesis of the amorphous polyester resin. In addition to the aliphatic diols mentioned in terms of the crystalline polyester resin, examples of the alcohol component include bisphenol A, ethylene oxide adducts of bisphenol A, propylene oxide adducts of bisphenol A, hydrogenated bisphenol A, bisphenol S, ethylene oxide adducts of bisphenol S, and propylene oxide adducts of bisphenol S.

In view of toner productivity, heat resistance, and transparency, in particular, bisphenol S derivatives such as bisphenol S, ethylene oxide adducts of bisphenol S, and propylene oxide adducts of bisphenol S are desirably used. The carboxylic acid component and the alcohol component each may contain plural components. In particular, bisphenol S has an effect of enhancing heat resistance.

Hereinafter, for example, a cross-linking process for an amorphous resin or a crystalline resin used as a binder resin, and a copolymerization component that is usable in the synthesis of the binder resin will be described.

In the synthesis of the binder resin, another component may be used for copolymerization. A compound having a hydrophilic polar group may be used.

Specific examples of the compound are as follows. In the case where the binder resin is a polyester resin, the examples include dicarboxylic compounds in which an aromatic ring is directly substituted with a sulfonyl group, such as sodium sulfonyl-terephthalate and sodium 3-sulfonyl-isophthalate. In the case where the binder resin is a vinyl resin, the examples include unsaturated aliphatic carboxylic acids such as (meth)acrylic acid and itaconic acid; esters derived from (meth)acrylic acid and an alcohol or the like, such as glycerin mono(meth)acrylate, fatty-acid-modified glycidyl (meth) acrylate, zinc mono(meth)acrylate, zinc di(meth)acrylate, 2-hydroxyethyl (meth)acrylate, polyethylene glycol (meth) acrylate, and polypropylene glycol (meth)acrylate; styrene derivatives having a sulfonyl group at the ortho, meta, or para position; and sulfonyl-group-substituted aromatic vinyl compounds such as sulfonyl-group-containing vinyl naphthalene.

The binder resin may be mixed with a cross-linking agent.

Specific examples of the cross-linking agent include aromatic polyvinyl compounds such as divinylbenzene and divinylnaphthalene; polyvinyl esters of aromatic polycarboxylic acids, such as divinyl phthalate, divinyl isophthalate, divinyl terephthalate, divinyl homophthalate, divinyl/trivinyl trimesate, divinyl naphthalene dicarboxylate, and divinyl biphenyl carboxylate; divinyl esters of nitrogen-containing aromatic compounds, such as divinyl pyridine dicarboxylate; unsaturated heterocyclic compounds such as pyrrole and thiophene; vinyl esters of unsaturated heterocyclic compound carboxylic acids, such as vinyl pyromucate, vinyl furancarboxylate, vinyl pyrrole-2-carboxylate, and vinyl thiophene carboxylate; (meth)acrylates of straight-chain polyhydric alcohols, such as butanediol methacrylate, hexanediol acrylate, octanediol methacrylate, decanediol acrylate, and dodecanediol methacrylate; (meth)acrylates of branched or substituted polyhydric alcohols, such as neopentyl glycol dimethacrylate and 2-hydroxy 1,3-diacryloxypropane; polyethylene glycol di(meth)acrylate, polypropylene polyethylene glycol di(meth)acrylates; and polyvinyl esters of polycarboxylic acids, such as divinyl succinate, divinyl fumarate, vinyl/divinyl maleate, divinyl diglycolate, vinyl/divinyl itaconate, divinyl acetonedicarboxylate, divinyl glutarate, 3,3'-divinyl thiodipropionate, divinyl/trivinyl trans-aconitate, divinyl adipate, divinyl pimelate, divinyl suberate, divinyl azelate, divinyl sebacate, divinyl dodecanedioate, and divinyl brassylate.

In particular, in a crystalline polyester resin, an unsaturated polycarboxylic acid such as fumaric acid, maleic acid, itaconic acid, or trans-aconitic acid may be introduced into the polyester through copolymerization; and cross-linking may be subsequently achieved with multiple bond regions in the resin or another vinyl compound. In the exemplary embodiment, such cross-linking agents may be used alone or in combination of two or more thereof.

A method of achieving cross-linking with such a cross-linking agent may be a method in which polymerization of a polymerizable monomer is performed together with the cross-linking agent to achieve cross-linking; or a method in which unsaturated regions are left in a binder resin and, after polymerization of the binder resin or after preparation of toner, the unsaturated regions are subjected to cross-linking by a cross-linking reaction.

In the case where the binder resin is a polyester resin, a polymerizable monomer may be polymerized by polycondensation. A catalyst used for polycondensation may be selected from publicly known catalysts. Specific examples of the catalysts include titanium tetrabutoxide, dibutyltin oxide, germanium dioxide, antimony trioxide, tin acetate, zinc acetate, and tin disulfide. In the case where the binder resin is a vinyl resin, a polymerizable monomer may be polymerized by radical polymerization.

A radical polymerization initiator is not particularly limited as long as it allows emulsion polymerization. Specific examples of the radical polymerization initiator include peroxides such as hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, ammonium persulfate, sodium persulfate, potassium persulfate, peroxycarbonic acid diisopropyltetralin hydroperoxide, 1-phenyl-2-methylpropyl-1-hydroperoxide, triphenyl peracetate tert-butyl hydroperoxide, tert-butyl performate, tert-butyl peracetate, tert-butyl perbenzoate, tert-butyl phenyl peracetate, tert-butyl methoxy peracetate, and tert-butyl N-(3-toluoyl) percarbamate; azo compounds such as 2,2'-azobispropane, 2,2'-dichloro-2,2'-azobispropane, 1,1'-azo (methylethyl)diacetate, 2,2'-azobis(2-amidinopropane) hydrochloride, 2,2'-azobis(2-amidinopropane)nitrate, 2,2'-azobisisobutane, 2,2'-azobisisobutylamide, 2,2'-azobisisobutyronitrile, methyl 2,2'-azobis-2-methylpropionate, 2,2'-dichloro-2,2'-azobisbutane, 2,2'-azobis-2-methylbutyronitrile, dimethyl 2,2'-azobisisobutyrate, 1,1'-azobis(sodium 1-methylbutyronitrile-3-sulfonate), 2-(4-methylphenylazo)-2-methylmalonodinitrile, 4,4'-azobis-4-cyanovaleric acid, 3,5-dihydroxymethylphenylazo-2-methylmalonodinitrile, 2-(4-bromophenylazo)-2-allylmalonodinitrile, 2,2'-azobis-2-methylvaleronitrile, dimethyl 4,4'-azobis-4-cyanovalerate, 2,2'-azobis-2,4-dimethylvaleronitrile, 1,1'-azobiscyclohexanenitrile, 2,2'-azobis-2-propylbutyronitrile, 1,1'-azobis-1-chlorophenylethane, 1,1'-azobis-1-cyclohexanecarbonitrile, 1,1'-azobis-1-cycloheptanenitrile, 1,1'-azobis-1-phenylethane, 1,1'-azobiscumene, ethyl 4-nitrophenylazobenzylcyanoacetate, phenylazodiphenylmethane, phenylazotriphenylmethane, 4-nitrophenylazotriphenylmethane, 1,1'-azobis-1,2-diphenylethane, poly(bisphenol A-4,4'-azobis-4-cyanopentanoate), and poly(tetraethyleneglycol-2,2'-azobisisobutyrate); 1,4-bis(pentaethylene)-2-tetrazene and 1,4-dimethoxycarbonyl-1,4-diphenyl-2-tetrazene. Such a polymerization initiator may also be used as an initiator for a cross-linking reaction.

Regarding the binder resin, crystalline polyester resins and amorphous polyester resins have been described. Other examples of the binder resin include homopolymers of, for example, styrenes such as styrene, para-chlorostyrene, and α-methyl styrene; acrylic monomers such as methyl acrylate, ethyl acrylate, n-propyl acrylate, butyl acrylate, lauryl acrylate, and 2-ethylhexyl acrylate; methacrylic monomers such as methyl methacrylate, ethyl methacrylate, n-propyl methacrylate, lauryl methacrylate, and 2-ethylhexyl methacrylate; ethylene-based unsaturated acid monomers such as acrylic acid, methacrylic acid, and sodium styrenesulfonate; vinyl nitriles such as acrylonitrile and methacrylonitrile; vinyl ethers such as vinyl methyl ether and vinyl isobutyl ether; vinyl ketones such as vinyl methyl ketone, vinyl ethyl ketone, and vinyl isopropenyl ketone; and olefin monomers such as ethylene, propylene and butadiene. The examples further include copolymers derived from two or more of such monomers; mixtures of such polymers; epoxy resins, polyester resins, polyurethane resins, polyamide resins, cellulose resins, polyether resins, non-vinyl condensed resins, mixtures of the foregoing and vinyl resins; and graft polymers synthesized by polymerizing a vinyl monomer in the presence of the foregoing.

In the case where the toner is produced by an emulsion polymerization aggregation method as described below, the above-described resin is prepared as a resin particle dispersion liquid. The resin particle dispersion liquid is easily obtained by an emulsion polymerization method or a similar polymerization method in an uneven dispersion system. Alternatively, the resin particle dispersion liquid may be obtained by, for example, the following method: a polymer evenly polymerized by a solution polymerization method, a bulk polymerization method, or the like is added together with a stabilizing agent to a solvent that does not dissolve the polymer, and the polymer is mechanically mixed and dispersed.

For example, in the case where a vinyl monomer is used, a resin particle dispersion liquid may be produced by an emulsion polymerization method or a seed polymerization method with an ionic surfactant or the like, desirably with a combination of an ionic surfactant and a nonionic surfactant.

Non-limiting examples of the surfactants used here include anionic surfactants such as sulfates, sulfonates, phosphates, and soaps; cationic surfactants such as amine salts and quaternary ammonium salts; nonionic surfactants such as polyethylene glycols, alkylphenol ethyleneoxide adducts, alkylalcohol ethyleneoxide adducts, and polyhydric alcohols; and various graft polymers.

In the case where a resin particle dispersion liquid is produced by emulsion polymerization, in particular, an unsaturated acid such as acrylic acid, methacrylic acid, maleic acid, or styrenesulfonic acid is desirably added as a portion of the monomer components so that protective colloidal layers are formed on the surfaces of particles and soap-free polymerization may be performed.

The resin particles desirably have a volume-average particle size of 1 μm or less, more desirably 0.01 μm or more and 1 μm or less. The average particle size of resin particles is measured with a laser diffraction particle size distribution analyzer (SALD2000A, manufactured by SHIMADZU CORPORATION).

Release Agent

The release agent used for the toner is not particularly limited. Examples of the release agent include the following various waxes.

Specific examples of the release agent include waxes of low-molecular-weight polyolefins such as polyethylene, polypropylene, and polybutene; silicones; waxes of fatty amides such as oleic acid amide, erucic acid amide, ricinoleic acid amide, and stearic acid amide; plant waxes such as carnauba wax, rice wax, candelilla wax, Japan wax, and jojoba oil; animal waxes such as beeswax; mineral and petroleum waxes such as montan wax, ozokerite, ceresin, paraffin wax, microcrystalline wax, and Fischer-Tropsch wax; and modified substances of the foregoing.

In the case where the toner is produced by an emulsion polymerization aggregation method, the release agent may be dispersed in water together with an ionic surfactant and a polymer electrolyte such as a polymer acid or a polymer base, and formed into fine particles by being heated at the melting temperature or higher and also by using a homogenizer or a pressure discharge dispersing apparatus that apply a high shearing force, so that the release agent dispersion liquid containing release agent particles having an average particle size of 1 μm or less may be used.

The release agent particles may be added to a solvent mixture together with other resin particle components during the production of the toner, all at once or stepwise in portions.

The amount of the release agent added with respect to the entire toner particles is desirably in the range of 0.5% by mass or more and 50% by mass or less, more desirably in the range of 1% by mass or more and 30% by mass or less, and still more desirably in the range of 5% by mass or more and 15% by mass or less.

The release agent particles dispersed in the toner particles desirably have an average dispersion size in the range of 0.3 μm or more and 0.8 μm or less, more desirably in the range of 0.4 μm or more and 0.8 μm or less.

The standard deviation of the dispersion sizes of release agent particles is desirably 0.05 or less, more desirably 0.04 or less.

The average dispersion size of release agent particles dispersed in toner particles is determined by analyzing a TEM (transmission electron microscope) micrograph with an image analysis apparatus (Luzex image analysis apparatus, manufactured by NIRECO CORPORATION) and calculating the average of dispersion sizes (=(length+width)/2) of 100 release agent particles in the toner; the standard deviation is calculated from the obtained dispersion sizes.

The exposure ratio of the release agent from toner particles is desirably in the range of 5 atom % or more and 12 atom % or less, more desirably in the range of 6 atom % or more and 11 atom % or less.

This exposure ratio is determined by XPS (X-ray photoelectron spectroscopy). An XPS measurement apparatus used is JPS-9000MX manufactured by JEOL Ltd. The measurement is performed with MgKα radiation serving as an X-ray source, an acceleration voltage of 10 kV, and an emission current of 30 mA. Here, a peak-separation method for a C1S spectrum is used to determine the amount of the release agent on the surfaces of toner particles. In the peak-separation method, the measured C1S spectrum is separated into components by curve fitting using the least squares method. The component spectra serving as the bases of the separation are C1S spectra obtained by independently measuring the release agent, the binder resin, and the crystalline resin used for producing the toner.

Coloring Agent

Examples of the coloring agent include various pigments such as carbon black, chrome yellow, Hansa yellow, benzidine yellow, thren yellow, quinoline yellow, permanent orange GTR, pyrazolone orange, vulcan orange, Watchung Red, permanent red, brilliant carmin 3B, brilliant carmin 6B, Dupont oil red, pyrazolone red, lithol red, rhodamine B lake, lake red C, rose bengal, aniline blue, ultramarine blue, calco oil blue, methylene blue chloride, phthalocyanine blue, phthalocyanine green, and malachite green oxalate; and various dyes such as acridine dyes, xanthene dyes, azo dyes, benzoquinone dyes, azine dyes, anthraquinone dyes, thioindigo dyes, dioxazine dyes, thiazine dyes, azomethine dyes, indigo dyes, phthalocyanine dyes, aniline black dyes, polymethine dyes, triphenylmethane dyes, diphenylmethane dyes, and thiazole dyes. These coloring agents may be used alone or in combination of two or more thereof.

In the case where toner particles are produced by an emulsion polymerization aggregation method, such a coloring agent is also dispersed in a solvent and used as a coloring agent dispersion liquid. In this case, the coloring agent particles desirably have a volume-average particle size of 0.8 μm or less, more desirably 0.05 μm or more and 0.5 μm or less.

The content ratio of coarse particles having a volume-average particle size of 0.8 μm or more in the coloring agent dispersion liquid is desirably less than 10% by particle count, desirably 0% by particle count; and the content ratio of fine particles having an average particle size of 0.05 μm or less in the coloring agent dispersion liquid is desirably 5% or less by particle count.

The volume-average particle size of coloring agent particles is also measured with a laser diffraction particle size distribution analyzer (SALD2000A, manufactured by SHIMADZU CORPORATION). The amount of the coloring agent added with respect to the entire toner is desirably set in the range of 1% by mass or more and 20% by mass or less.

The method of dispersing such a coloring agent in a solvent may be any method and is not limited at all. For example, a rotary shearing homogenizer or a media-containing dispersion system such as a ball mill, a sand mill, or a dyno mill may be used.

The coloring agent may be surface-modified with rosin, polymer, or the like. Such a surface-modified coloring agent is stabilized in the coloring agent dispersion liquid; and, after the coloring agent is dispersed in the coloring agent dispersion liquid so as to have a predetermined average particle size, for example, even during mixing with a resin particle dispersion liquid and in the aggregation step, aggregation of coloring agent particles does not occur and a good dispersion state is maintained.

Examples of the polymer used for the surface treatment of the coloring agent include acrylonitrile polymers and methyl methacrylate polymers.

In general, the surface modification may be performed by, for example, a polymerization method in which a monomer is polymerized in the presence of a coloring agent (pigment), or a phase separation method in which a coloring agent (pigment) is dispersed in a polymer solution and the solubility of the polymer is decreased to deposit the polymer on the surfaces of the coloring agent (pigment) particles.

Other Additive Components

Examples of other additive components include various well-known additive components.

Specifically, in the case of using the toner as a magnetic toner, a magnetic powder is added as another additive component.

Examples of the material of the magnetic powder include metals, alloys, and compounds containing such metals, such as ferrite, magnetite, reduced iron, cobalt, nickel, and manganese. In addition, various charge control agents that are generally used may be added, such as quaternary ammonium salts, nigrosine compounds, and triphenylmethane pigments.

The toner may contain inorganic particles. Regarding the inorganic particles, inorganic particles having a median particle size of 5 nm or more and 30 nm or less and inorganic particles having a median particle size of 30 nm or more and 100 nm or less, are desirably contained in the range of 0.5% by mass or more and 10% by mass or less with respect to the toner in view of durability.

Examples of the material of the inorganic particles include silica, silica treated so as to be hydrophobic, titanium oxide, alumina, calcium carbonate, magnesium carbonate, tricalcium phosphate, colloidal silica, cation-surface-treated colloidal silica, and anion-surface-treated colloidal silica. Such inorganic particles are, in advance, subjected to a dispersion treatment in the presence of an ionic surfactant with an ultrasonic dispersing apparatus or the like. Use of colloidal silica, which does not require the dispersion treatment, is desirable.

External Additive

In the toner, a publicly known external additive may be made to adhere to toner particles.

Examples of the external additive include inorganic particles formed of silica, alumina, titania, calcium carbonate, magnesium carbonate, tricalcium phosphate, or the like. Examples of a fluidizer and a cleaning aid include inorganic particles formed of silica, alumina, titania, calcium carbonate, or the like, and resin particles formed of a vinyl resin, polyester, silicone, or the like.

The method of adding such an external additive is not particularly limited. For example, an external additive may be added to the surfaces of toner particles under application of a shearing force in a dry state.

Method of Producing Toner Particles

Hereinafter, a method of producing toner particles will be described.

Toner particles may be produced by any publicly known toner production method. In particular, toner particles are desirably produced by the so-called wet process including a particle formation step of forming coloring agent particles containing a binder resin and a coloring agent in water, an organic solvent, or a solvent mixture thereof, and a washing-drying step of washing and drying the coloring agent particles.

Non-limiting examples of the wet process include a suspension polymerization method in which a coloring agent, a release agent, and other components are suspended together with a polymerizable monomer that forms a binder resin such as an amorphous resin, and the polymerizable monomer is polymerized; a dissolution suspension method in which toner constitutional materials such as a compound having an ionic dissociable group, a binder resin, a coloring agent, and a release agent are dissolved in an organic solvent and dispersed in an aqueous solvent in a suspension state, and the organic solvent is subsequently removed; and an emulsion polymerization aggregation method in which a binder resin component such as an amorphous resin is prepared by emulsion polymerization and subjected to heteroaggregation with dispersion liquids of a coloring agent (pigment), a release agent, and the like to subsequently undergo coalescence. Of these, the emulsion polymerization aggregation method is optimal because it is excellent in terms of toner particle size controllability, narrow particle size distribution, shape controllability, narrow shape distribution, internal dispersion controllability, and the like.

In the case of using the emulsion polymerization aggregation method, toner particles may be produced by, for example, at least an aggregation step of forming aggregate particles in a raw-material dispersion liquid that is a mixture of a resin particle dispersion liquid in which a binder resin such as an amorphous resin or a crystalline resin is dispersed, a coloring agent dispersion liquid in which a coloring agent is dispersed, and a release agent dispersion liquid in which a release agent is dispersed; and a coalescence step of coalescing the aggregate particles by heating the raw-material dispersion liquid containing the aggregate particles to a temperature equal to or higher than the glass transition temperature of the binder resin (or the melting temperature of the crystalline resin). Note that, to the raw-material dispersion liquid, another dispersion liquid such as an inorganic particle dispersion liquid may be added. In particular, in the case where a dispersion liquid of inorganic particles whose surfaces have been treated hydrophobic is added, depending on the degree of hydrophobicity, the dispersibility of the release agent and the crystalline resin within the toner may be controlled.

Hereinafter, a method of producing toner particles will be further described in detail with reference to the emulsion polymerization aggregation method serving as a specific example.

In the case where toner particles are produced by the emulsion polymerization aggregation method, at least an aggregation step and a coalescence step are performed. In addition, an adhesion step may be performed in which resin particles are made to adhere to the surfaces of aggregate particles (core particles) formed by the aggregation step to form aggregate particles having a core-shell structure.

Aggregation Step

In the aggregation step, aggregate particles are formed in a raw-material dispersion liquid that is a mixture of a resin particle dispersion liquid in which a binder resin such as an amorphous resin or a crystalline resin is dispersed (note that dispersion liquids of an amorphous resin, a crystalline resin, and the like may be individually prepared), a coloring agent dispersion liquid in which a coloring agent is dispersed, and a release agent dispersion liquid in which a release agent is dispersed.

Specifically, the raw-material dispersion liquid obtained by mixing various dispersion liquids is heated so that particles in the raw-material dispersion liquid are aggregated to form aggregate particles. This heating is performed at a temperature less than the glass transition temperature of the amorphous resin, desirably 5° C. to 25° C. lower than the glass transition temperature.

The aggregate particles are formed by, under stirring with a rotary shearing homogenizer, adding an aggregating agent at room temperature (23° C.) and adjusting the pH of the raw-material dispersion liquid to an acidic range.

The aggregating agent used in the aggregation step is suitably a surfactant having a polarity that is opposite to the polarity of a surfactant added as a dispersing agent to the raw-material dispersion liquid. Examples of the aggregating agent suitably used include inorganic metal salts and metal complexes having a valence of two or more. In particular, use of such a metal complex is desirable because the amount of the surfactant used is reduced and the charging characteristics are enhanced.

Examples of the inorganic metal salts include metal salts such as calcium chloride, calcium nitrate, barium chloride, magnesium chloride, zinc chloride, aluminum chloride, and aluminum sulfate; and inorganic metal salt polymers such as polyaluminum chloride, polyaluminum hydroxide, and calcium polysulfide. Of these, in particular, aluminum salts and polymers thereof are suitable. In order to provide a sharper particle size distribution, regarding the valence of such an inorganic metal salt, divalence is more suitable than monovalence; trivalence is more suitable than divalence; tetravalence is more suitable than trivalence; and, in the case of the same valence, the polymer of an inorganic metal salt is more suitable than the inorganic metal salt.

In the aggregation step, at the time when an inorganic particle dispersion liquid of such an inorganic metal salt is added, aggregation is desirably caused. In this case, the inorganic metal salt effectively acts on molecular chain ends of the binder resin, contributing to the formation of a cross-linking structure.

The inorganic particle dispersion liquid may be produced by, for example, the same method as in the coloring agent dispersion liquid described above. The dispersion average particle size of the inorganic particles is desirably in the range of 100 nm or more and 500 nm or less.

In the aggregation step, the inorganic particle dispersion liquid may be added in a stepwise manner or a continuous manner. These manners are effective in that a uniform distribution of the inorganic particles from the surface to inside of toner particles is achieved. In particular, in the case of adding the dispersion liquid in a stepwise manner, the dispersion liquid is desirably added by three or more steps; in the case of adding the dispersion liquid in a continuous manner, the dispersion liquid is desirably added at a low speed of 0.1 g/m or less.

The amount of the inorganic particle dispersion liquid added varies depending on the type of metal used and the degree of formation of a cross-linking structure; however, with respect to 100 parts by mass of the binder resin component, the amount is desirably in the range of 0.5 parts by mass or more and 10 parts by mass or less, more desirably in the range of 1 part by mass or more and 5 parts by mass or less.

After the aggregation step is performed, the adhesion step may be performed. In the adhesion step, resin particles are made to adhere to the surfaces of aggregate particles formed by the aggregation step, so that cover layers are formed. As a result, toner particles having the so-called core-shell structure having a core layer and a layer covering the core layer are obtained.

In general, the cover layers are formed by further adding, to the dispersion liquid in which aggregate particles (core particles) have been formed in the aggregation step, a dispersion liquid containing amorphous resin particles. Note that the amorphous resin used in the adhesion step may be the same as or different to that used in the aggregation step.

In general, the adhesion step is performed in the case where toner particles having a core-shell structure containing, as a main component, a crystalline resin as a binder resin together with a release agent are produced. The adhesion step is substantially performed for suppressing, in the surfaces of toner particles, exposure of a release agent and a crystalline resin contained in the core layers, and for increasing the strength of toner particles.

Coalescence Step

The coalescence step is performed after the aggregation step is performed or the aggregation step and the adhesion step are performed. In the coalescence step, the pH of the suspension containing aggregate particles and formed in such a step is adjusted to be in a predetermined range to stop the aggregation; and heating is performed to cause coalescence of the aggregate particles.

The pH is adjusted by adding an acid or an alkali. The acid is not particularly limited; however, a 0.1% or more and 50% or less aqueous solution of an inorganic acid such as hydrochloric acid, nitric acid, or sulfuric acid is desirable. The alkali is not particularly limited; however, a 0.1% or more and 50% or less aqueous solution of an alkali metal hydroxide such as sodium hydroxide or potassium hydroxide is desirable. In the adjustment of pH, a local change in pH may cause local destruction of aggregation particles themselves or local excessive aggregation and may also cause degradation of the shape distribution. In particular, as the scale is increased, the amount of acid or alkali is increased. In general, acid or alkali is introduced from a single port; accordingly, as the scale is increased, the concentration of acid or alkali at the introduction port is increased in order to achieve the adjustment in the same time irrespective of the increase in the scale.

In order to adjust the content ratio of group IA elements (except for hydrogen) to be in the range of the exemplary embodiment, the pH is desirably adjusted to be in the range of 6.0 or more and 8.0 or less, more desirably in the range of 6.5 or more and 7.5 or less.

After the composition is thus controlled, the aggregate particles are heated to undergo coalescence. During this heating, elements react with molecular chain ends of resins to form a cross-linking structure.

The coalescence of aggregate particles is achieved by heating at a temperature that is equal to or higher than the glass transition temperature of the amorphous resin (or the melting temperature of the crystalline resin).

During the heating for coalescence or after completion of coalescence, another component may be used to cause a cross-linking reaction. During coalescence, a cross-linking reaction may be caused. In the case of causing a cross-linking reaction, the above-described cross-linking agent or polymerization initiator is used during the production of toner particles.

The polymerization initiator may be mixed in advance with the raw-material dispersion liquid in its preparation, may be incorporated into aggregate particles in the aggregation step, or may be introduced during the coalescence step or after the coalescence step. In the case where the polymerization initiator is introduced during the aggregation step, the adhesion step, or the coalescence step or after the coalescence step, a liquid in which the polymerization initiator is dissolved or emulsified is added to the dispersion liquid. To the polymerization initiator, a publicly known additive such as a cross-linking agent, a chain transfer agent, or a polymerization inhibitor may be added for the purpose of controlling the degree of polymerization.

Washing-Drying Step Etc.

After the step of coalescence of aggregate particles is completed, a washing step, a solid-liquid separation step, a drying step, and the like may be performed. After these steps are performed, the target toner particles are obtained.

In the washing step, in view of chargeability, displacement washing with ion-exchanged water is desirably performed.

The solid-liquid separation step is not particularly limited; however, in view of productivity, for example, suction filtration or pressure filtration is desirably performed. The drying step is also not particularly limited; however, in view of productivity, for example, freeze-drying, flash jet drying, fluidized drying, or vibration fluidized drying is desirably used.

To the thus-obtained toner particles, various external additives are added to provide the toner.

Properties of Toner

Hereinafter, properties of the toner will be described.

The volume-average particle size D50v of the toner is desirably 0.1 μm or more, more desirably 0.5 μm or more, still more desirably 2 μm or more. The upper limit of the volume-average particle size D50v is desirably 10 μm or less, more desirably 6 μm or less, still more desirably 4 μm or less.

The volume-average particle size distribution index GSDv of the toner is desirably 1.28 or less while the number-average particle size distribution index GSDp is desirably 1.30 or less. More desirably, the volume-average particle size distribution index GSDv is 1.25 or less and the number-average particle size distribution index GSDp is 1.25 or less.

The volume-average particle size D50v and various particle size distribution indices of the toner are measured, for example, with a Multisizer II (manufactured by Beckman Coulter, Inc.) and an electrolyte ISOTON-II (manufactured by Beckman Coulter, Inc.). In the measurement, a surfactant is used as a dispersing agent: desirably, to a 5% aqueous solution (2 ml) of sodium alkylbenzene sulfonate, 0.5 mg or more and 50 mg or less of a measurement sample is added; and this solution is added to 100 ml or more and 150 ml or less of the electrolyte.

The electrolyte in which the sample is suspended is subjected to a dispersion treatment with an ultrasonic dispersion apparatus for a minute. This electrolyte is measured in terms of particle size distribution in the particle size range of 2.0 μm to 60 μm with a Multisizer II using an aperture size of 100 μm. The number of particles sampled is 50000.

For particle size ranges (channels) divided on the basis of the thus-measured particle size distribution, cumulative distributions are drawn from the small particle size side in terms of volume and number. The particle sizes at which the cumulative amounts reach 16% are defined as a cumulative volume particle size D16v and a cumulative number particle size D16p. The particle sizes at which the cumulative amounts reach 50% are defined as a cumulative volume-average particle size D50v and a cumulative number-average particle size D50p. The particle sizes at which the cumulative amounts reach 84% are defined as a cumulative volume particle size D84v and a cumulative number particle size D84p.

From these particle sizes, the volume-average particle size distribution index (GSDv) is calculated with a formula $(D84v/D16v)^{1/2}$; and the number-average particle size distribution index (GSDp) is calculated with a formula $(D84p/D16p)^{1/2}$.

The average circularity of the toner is desirably in the range of 0.940 or more and 0.980 or less, more desirably in the range of 0.950 or more and 0.970 or less.

The average circularity of the toner is measured with a flow particle image analyzer FPIA-2000 (manufactured by TOA Medical Electronics). Specifically, the measurement is performed as follows. In 100 ml to 150 ml of water from which impurity solid matter has been removed in advance, a surfactant is added as a dispersing agent: desirably, 0.1 ml or more and 0.5 ml or less of an alkylbenzene sulfonate is added and 0.1 g or more and 0.5 g or less of a measurement sample is added. The suspension in which the measurement sample is dispersed is subjected to a dispersion treatment with an ultrasonic dispersion apparatus for 1 to 3 minutes. Thus, the dispersion liquid is prepared so as to have a concentration of $3\times10^7$ particles/μl or more and $1\times10^4$ particles/μl or less. This dispersion liquid is measured with the analyzer in terms of the average circularity of the toner.

The glass transition temperature of the toner is not particularly limited; however, the glass transition temperature is desirably in the range of 40° C. or more and 70° C. or less.

Note that the glass transition temperature of the toner is measured by the same measurement method as the measurement method for the glass transition temperature of a binder resin.

Carrier Solution

The carrier solution used in the exemplary embodiment is a carrier solution containing at least a non-volatile oil.

Note that, in this Specification, the term "volatile" means a flash point of 100° C. or less; and the term "non-volatile" means a flash point of 130° C. or more.

Examples of suitable non-volatile oils include silicone oils, paraffin oils, and vegetable oils. These oils may be used alone or in combination as a mixture of two or more thereof.

Examples of the non-volatile silicone oils include KF-96 (that has a kinematic viscosity of 10 $mm^2/s$ or more, manufactured by Shin-Etsu Chemical Co., Ltd.) and SH200 (that has a kinematic viscosity of 10 $mm^2/s$ or more, manufactured by Dow Corning Toray Co., Ltd.).

Examples of the non-volatile paraffin oils include MORESCO White P-40 (non-volatile, manufactured by Matsumura Oil Co., Ltd.) and Isopar V (manufactured by Exxon Chemical Company).

In the exemplary embodiment, the carrier solution may contain a volatile oil. In the case where a non-volatile oil and a volatile oil are used in combination, the proportion of the non-volatile oil is preferably 50% by mass or more, more preferably 80% by mass or more. Still more preferably, a non-volatile oil alone is used.

Examples of a volatile oil used in combination with a non-volatile oil include silicone oils, paraffin oils, and vegetable oils. These oils may be used alone or in combination as a mixture of two or more thereof.

Examples of the volatile silicone oils include KF-96L (that has a kinematic viscosity of 2 $mm^2/s$ or less, manufactured by Shin-Etsu Chemical Co., Ltd.) and SH200 (that has a kinematic viscosity of 2 $mm^2/s$ or less, manufactured by Dow Corning Toray Co., Ltd.).

Examples of the volatile paraffin oils include MORESCO White MT-30P (manufactured by Matsumura Oil Co., Ltd.) and Isopar L and Isopar H (manufactured by Exxon Chemical Company).

In the exemplary embodiment, the carrier solution used is desirably a non-volatile oil alone. In particular, in the case where a polyester resin is used as the binder resin of the toner, in view of affinity for the binder resin, a silicone oil is desirably used.

The flash point of the carrier solution is desirably 150° C. or more, more desirably 200° C. or more.

The flash point is measured in accordance with JIS K2265-4 (2007).

The carrier solution may contain various subsidiary materials as long as the function thereof is not degraded. Examples of the subsidiary materials include a dispersing agent, an emulsifying agent, a surfactant, a stabilizer, a wetting agent, a thickener, a foaming agent, a defoaming agent, a coagulating agent, a gelling agent, an anti-settling agent, a charge control agent, an antistatic agent, an age resister, a softening agent, a plasticizer, a filler, an oderant, an anti-tack agent, and a release agent.

EXAMPLES

Hereinafter, the exemplary embodiment will be specifically described with reference to Examples below, which do not limit the present invention. The terms "parts" and "%" below are based on mass unless otherwise specified.

Measurements of Various Properties

Methods of measuring various properties (molecular weight, particle size, glass transition temperature, and melting temperature) in Examples below will be described.

Molecular Weight

The weight-average molecular weight and the number-average molecular weight are measured by gel permeation chromatography (GPC). The measurement of molecular weight by GPC is performed with a measurement apparatus, GPC HLC-8120 manufactured by Tosoh Corporation in which TSKgel SuperHM-M (15 cm) columns manufactured by Tosoh Corporation and a THF (tetrahydrofuran) solvent are used. From the measurement result, the weight-average molecular weight and the number-average molecular weight are calculated with molecular-weight calibration curves formed with monodisperse polystyrene standard samples.

Various Average Particle Sizes and Various Particle Size Distribution Indices

Various average particle sizes and various particle size distribution indices are measured with a Coulter Multisizer II (manufactured by Beckman Coulter, Inc.) and an electrolyte ISOTON-II (manufactured by Beckman Coulter, Inc.).

In the measurement, a surfactant (desirably sodium alkylbenzene sulfonate) is used as a dispersing agent. To a 5% aqueous solution (2 ml) of the surfactant, 0.5 mg or more and 50 mg or less of a measurement sample is added; and this solution is added to 100 ml or more and 150 ml or less of the electrolyte.

The electrolyte in which the sample is suspended is subjected to a dispersion treatment with an ultrasonic dispersion apparatus for a minute. This electrolyte is measured in terms of particle size distribution in the particle size range of 2 μm or more and 60 μm or less with a Coulter Multisizer II using an aperture size of 100 μm. The number of particles sampled is 50000.

For particle size ranges (channels) divided on the basis of the thus-measured particle size distribution, cumulative distributions are drawn from the small particle size side in terms of volume and number. The particle sizes at which the cumulative amounts reach 16% are defined as a volume particle size D16v and a number particle size D16p. The particle sizes at which the cumulative amounts reach 50% are defined as a volume-average particle size D50v and a cumulative number-average particle size D50p. The particle sizes at which the cumulative amounts reach 84% are defined as a volume particle size D84v and a number particle size D84p.

From these particle sizes, the volume-average particle size distribution index (GSDv) is calculated with a formula $(D84v/D16v)^{1/2}$; and the number-average particle size distribution index (GSDp) is calculated with a formula $(D84p/D16p)^{1/2}$.

Volume-Average Particle Size: Particle Size of 2 μm or Less

The volume-average particle size in terms of the particle size range of 2 μm or less is measured as follows. A particle size distribution measured with a laser diffraction particle size distribution analyzer (for example, LA-700, manufactured by HORIBA, Ltd.) is used. For particle size ranges (channels) divided in the particle size distribution, a cumulative distribution is drawn from the small particle size side in terms of volume. The particle size at which the cumulative amount with respect to the entire particles reaches 50% is measured as a volume-average particle size D50p.

Melting Temperature and Glass Transition Temperature of Resin and Release Agent

The melting temperature and the glass transition temperature are measured from the main maximum peak measured by the DSC (differential scanning calorimeter) measurement method in accordance with ASTMD3418-8. The main maximum peak is measured with DSC-7 manufactured by PerkinElmer, Inc.

Example A

Production of Various Toners

Hereinafter, toners used in Examples and Comparative examples will be described.

Production of Toner (1)

Preparation of Amorphous Polyester Resin (1)

- polyoxyethylene(2,0)-2,2-bis(4-hydroxyphenyl)propane: 35 molar parts
- polyoxypropylene(2,2)-2,2-bis(4-hydroxyphenyl)propane: 65 molar parts
- terephthalic acid: 80 molar parts
- n-dodecenyl succinic acid: 15 molar parts
- trimellitic acid: 10 molar parts These materials and dibutyltin oxide (0.05 molar parts with respect to 100 molar parts of the total of the acid components) are placed in a heat-dried two-neck flask. A nitrogen gas is introduced into the flask and the inert atmosphere is maintained and the temperature is increased. After that, a copolycondensation reaction is caused in the range of 150° C. or more and 230° C. or less for 12 hours. Subsequently, the pressure is gradually decreased in the range of 210° C. or more and 250° C. or less to provide an amorphous polyester resin (1).

The amorphous polyester resin (1) has a weight-average molecular weight of 15000 and a number-average molecular weight of 6800.

The melting temperature (Tm) of the amorphous polyester resin (1) is measured with a differential scanning calorimeter (DSC). As a result, a clear peak is not observed and a stepped endothermic change is observed. The middle point of the stepped endothermic change is determined as the glass transition temperature, which is 62° C.

Preparation of Amorphous Resin Particle Dispersion Liquid (1)

In the emulsification tank of an emulsification apparatus (CAVITRON CD1010, slit: 0.4 mm), 3000 parts of the amorphous polyester resin (1), 10000 parts of ion-exchanged water, and 90 parts of sodium dodecylbenzenesulfonate serving as a surfactant are placed, heat-melted at 130° C., then dispersed at 110° C. at 10000 rpm for 30 minutes, and passed through a cooling tank at a flow rate of 3 L/min. Thus, a resin particle dispersion liquid is collected to obtain an amorphous resin particle dispersion liquid (1).

The resin particles in the amorphous resin particle dispersion liquid (1) have a volume-average particle size of 0.3 μm and the standard deviation is 1.2.

Preparation of Crystalline Polyester Resin (2)

- 1,4-butanediol: 293 parts
- dodecanedicarboxylic acid: 750 parts
- catalyst (dibutyltin oxide): 0.3 parts These materials are placed in a heat-dried three-neck flask. The air in the flask is replaced with nitrogen gas through a pressure-reduction procedure to provide an inert atmosphere. The materials are mechanically stirred at 180° C. for 2 hours. After that, the temperature is gradually increased to 230° C. under a reduced pressure and stirring is performed for 5 hours. After the content becomes viscous, the content is air-cooled to terminate the reaction. Thus, a crystalline polyester resin (2) is obtained.

The crystalline polyester resin (2) has a weight-average molecular weight of 18000.

The melting temperature (Tm) of the crystalline polyester resin (2) is measured with a differential scanning calorimeter (DSC). As a result, a clear peak is observed and the temperature of the peak top is 70° C. (Tmp).

Preparation of Crystalline Resin Particle Dispersion Liquid (2)

A crystalline resin particle dispersion liquid (2) is prepared under the same conditions as in the amorphous resin particle dispersion liquid (1) except that the crystalline polyester resin (2) is used.

The particles in the crystalline resin particle dispersion liquid (2) have a volume-average particle size of 0.25 μm and the standard deviation is 1.3.

Preparation of Coloring Agent Dispersion Liquid (1)

C. I. Pigment Blue 15:3 (manufactured by Clariant): 25 parts anionic surfactant (Neogen RK, manufactured by DAI-ICHI KOGYO SEIYAKU CO., LTD.): 2 parts ion-exchanged water: 125 parts These materials are mixed and subjected to a dispersion treatment with a homogenizer (ULTRA-TURRAX, manufactured by IKA Works GmbH & Co. KG) to provide a coloring agent dispersion liquid (1).

Preparation of Release Agent Particle Dispersion Liquid (1)

paraffin wax (manufactured by Wako Pure Chemical Industries, Ltd., trade name: Paraffin, mp: 68° C. or more and 70° C. or less, melting temperature: 69° C.): 100 parts anionic surfactant (NEWREX R, manufactured by NOF CORPORATION): 2 parts ion-exchanged water: 300 parts These materials are mixed and subjected to a dispersion treatment with a homogenizer (ULTRA-TURRAX, manufactured by IKA Works GmbH & Co. KG) and further to a dispersion treatment with a pressure discharge homogenizer to provide a release agent particle dispersion liquid (1).

Preparation of Inorganic Particle Dispersion Liquid (1)

hydrophobic silica (RX200, manufactured by NIPPON AEROSIL CO., LTD.): 100 parts anionic surfactant (NEWREX R, manufactured by NOF CORPORATION): 2 parts ion-exchanged water: 1000 parts These materials are mixed and subjected to a dispersion treatment with a homogenizer (ULTRA-TURRAX, manufactured by IKA Works GmbH & Co. KG) and further to a dispersion treatment with an ultrasonic homogenizer (RUS-600CCVP, manufactured by NIHONSEIKI KAISHA LTD.) for 200 passes to provide an inorganic particle dispersion liquid (1).

Preparation of Toner Particles (1)

amorphous resin particle dispersion liquid (1): 145 parts
crystalline resin particle dispersion liquid (2): 30 parts
coloring agent dispersion liquid (1): 42 parts
release agent particle dispersion liquid (1): 36 parts
inorganic particle dispersion liquid (1): 10 parts
aluminum sulfate: 0.5 parts
ion-exchanged water: 300 parts These materials are placed in a round-bottom stainless steel flask and the pH is adjusted to be 2.7. The materials are dispersed with a homogenizer (ULTRA-TURRAX T50, manufactured by IKA Works GmbH & Co. KG) and then heated to 45° C. under stirring in a heating oil bath. The dispersion liquid is kept at 48° C. for 120 minutes and then kept at 48° C. for 30 minutes under heating and stirring. At this time, the pH of the dispersion liquid is 3.2. Subsequently, a 1 N sodium hydroxide aqueous solution is slowly added to adjust the pH of the dispersion liquid to be 8.0. Under continuous stirring, the dispersion liquid is subsequently heated to 90° C. and kept for 3 hours. After that, the reaction product is filtered, washed with ion-exchanged water, then dried with a vacuum desiccator to provide toner particles (1).

The toner particles (1) obtained have a volume-average particle size of 3.8 μm.

Production of Toner (1)

To 100 parts of the toner particles (1), 1 part of fumed silica (R972, manufactured by NIPPON AEROSIL CO., LTD.) is externally added through mixing with a Henschel mixer to provide a toner (1).

Production of Various Liquid Developers

Subsequently, the toner (1) obtained by the above-described method is used to provide liquid developers in the following manner.

Production of Liquid Developer (A)

In a glass bottle, the toner (1) obtained above and a silicone oil (KF-96-20cs, manufactured by Shin-Etsu Chemical Co., Ltd., non-volatile) are mixed such that the solid content concentration becomes 30% by mass. Thus, a liquid developer (A) is obtained.

Production of Liquid Developer (B)

A liquid developer (B) is obtained as with the liquid developer (A) except that the silicone oil (KF-96-20cs, manufactured by Shin-Etsu Chemical Co., Ltd., non-volatile) is replaced by a paraffin oil (MORESCO White P-40, manufactured by Matsumura Oil Co., Ltd., non-volatile).

Evaluation

Regarding Example A, in the case of using the silicone oil as the carrier solution and the case of using the paraffin oil as the carrier solution, the relationship between 60° gloss and the amount of the carrier solution on the surface of a toner image during passing through a nip is examined.

An image forming apparatus is prepared. This image forming apparatus has six heat-press roller pairs in the fixing unit. Regarding the six heat-press roller pairs, the most-downstream roller pair in the leading direction of the paper sheet is defined as "the first roller pair (most-downstream roller pair)"; and, the other roller pairs are defined, sequentially from the second-most-downstream roller pair, as "the second roller pair", "the third roller pair", "the fourth roller pair", "the fifth roller pair", and "the sixth roller pair (most-upstream roller pair)". Among these heat-press roller pairs, the second to sixth roller pairs other than the most-downstream roller pair (first roller pair) are equipped with cleaning blades that are individually detached or attached. By attaching or detaching the cleaning blades, the amount of the carrier solution on the surface of the toner layer in the nip of each roller pair may be controlled.

In addition, three carrier-solution removal roller pairs serving as carrier-solution removal units are provided upstream with respect to the fixing unit in the leading direction of the recording medium; and a non-contact infrared heating unit serving as a preheating unit for the paper sheet is provided upstream with respect to the carrier-solution removal units in the leading direction of the recording medium. In addition, detachable carrier-solution removal rollers serving as carrier-solution removal units are provided, on the surface of the photoconductor, at a position that is downstream with respect to the developing device and upstream with respect to the intermediate transfer body, and, on the surface of the intermediate transfer body, at a position that is downstream with respect to the photoconductor and upstream with respect to the transfer roller.

The developing device of the image forming apparatus is filled with the liquid developer (A) or the liquid developer (B) obtained above. Solid images with 100% concentration are formed on paper sheets (manufactured by Oji Paper Co., Ltd., OK Topkote+, 84.9 g/m$^2$). The fixing conditions are as follows: heating roller temperature of 140° C.; nip average pressure of 2.1 kg/cm$^2$ in heat-press roller pair; and dwell time of 7 ms.

In the formation of solid images, the amount of the carrier solution on the surface of a toner image during passing through the nip of the heat-press roller pair is controlled to be the amounts described in Table 1 below by adjusting the attachment-detachment setting of the cleaning blades for the heating rollers of the second to sixth heat-press roller pairs among the six heat-press roller pairs, by adjusting the attachment-detachment setting of the blades for the carrier-solution removal rollers in the three carrier-solution removal roller pairs, and by adjusting the attachment-detachment setting of the carrier-solution removal rollers on the surface of the photoconductor and the surface of the intermediate transfer body.

The amount of the carrier solution on the surface of a toner image during passing through the nip of the first roller pair (most-downstream roller pair) is measured by the above-described method. The result is described in Table 1 below.

Gloss Evaluation

The 60° gloss values of the solid images formed by the image forming apparatus are measured with a gloss meter (BYK micro-TRI-gloss meter (20+60+85°, manufactured by Gardner). The result is described in Table 1 below.

TABLE 1

| | Example | | | Comparative example | Example | | | Comparative example |
|---|---|---|---|---|---|---|---|---|
| | A1 | A2 | A3 | A1 | A4 | A5 | A6 | A2 |
| Type of carrier solution | Silicone oil | | | | Paraffin oil | | | |
| Amount of carrier solution [g/m$^2$] in first roller pair (most downstream) | 0.12 | 0.48 | 0.72 | 0.93 | 0.09 | 0.41 | 0.73 | 0.89 |
| 60° gloss | 38.5 | 35.7 | 25.2 | 11.2 | 35.0 | 33.7 | 26.3 | 13.4 |

Example B

Evaluation

The liquid developer (A) (liquid developer containing silicone oil) is used and, in the cases of changing the nip pressure, the relationship between 60° gloss and the amount of the carrier solution on the surface of a toner image during passing through a nip is examined.

Solid images are formed and 60° gloss is measured as in Example A except that the liquid developer (A) alone is used as the liquid developer, the amount of the carrier solution on the surface of a toner image during passing through the nip is controlled to be the amounts described in Table 2 below, and the nip average pressure in the heat-press roller pair during fixing is controlled to be the values described in Table 2 below.

TABLE 2

| | Example | | | Comparative example | Example | | | Comparative example | Example | | | Comparative example |
|---|---|---|---|---|---|---|---|---|---|---|---|---|
| | B1 | B2 | B3 | B1 | B4 | B5 | B6 | B2 | B7 | B8 | B9 | B3 |
| Type of carrier solution | Silicone oil | | | | | | | | | | | |
| Nip average pressure | 2.1 kgf/cm$^2$ | | | | 2.7 kgf/cm$^2$ | | | | 3.2 kgf/cm$^2$ | | | |
| Amount of carrier solution [g/m$^2$] in first roller pair (most downstream) | 0.12 | 0.48 | 0.72 | 0.93 | 0.10 | 0.37 | 0.71 | 0.90 | 0.08 | 0.36 | 0.73 | 0.83 |
| 60° gloss | 38.5 | 35.7 | 25.2 | 11.2 | 44.4 | 42.9 | 40.6 | 18.4 | 54.2 | 47.5 | 44.2 | 19.0 |

Example C

Liquid Developer C1

A liquid developer C1 is obtained by the above-described method for the liquid developer (A) except that, in the preparation of toner particles (1) in Example A, the composition is changed such that, in the toner, the content of the amorphous polyester resin is 80%, the content of the crystalline polyester resin is 7%, the content of the pigment (C. I. Pigment Blue 15:3) is 8%, and the content of the release agent (paraffin wax) is 5%.

Liquid Developer C2

A liquid developer C2 is obtained by the above-described method for the liquid developer (A) except that, in the preparation of toner particles (1) in Example A, the composition is changed such that, in the toner, the content of the amorphous polyester resin is 76%, the content of the crystalline polyester resin is 7%, the content of the pigment (C. I. Pigment Blue 15:3) is 8%, and the content of the release agent (paraffin wax) is 9%.

Liquid Developer C3

A liquid developer C3 is obtained by the above-described method for the liquid developer (A) except that, in the preparation of toner particles (1) in Example A, the composition is changed such that, in the toner, the content of the amorphous polyester resin is 72%, the content of the crystalline polyester resin is 7%, the content of the pigment (C. I. Pigment Blue 15:3) is 8%, and the content of the release agent (paraffin wax) is 13%.

Liquid Developer C4

A liquid developer C4 is obtained by the above-described method for the liquid developer (A) except that, in the preparation of toner particles (1) in Example A, the release agent is changed from the paraffin wax to an ester wax (WEP-3, manufactured by NOF CORPORATION, melting temperature: 73° C.), and the composition is changed such that, in the toner, the content of the amorphous polyester resin is 76%, the content of the crystalline polyester resin is 7%, the content of the pigment (C. I. Pigment Blue 15:3) is 8%, and the content of the release agent (ester wax) is 9%.

Liquid Developer C5

A liquid developer C5 is obtained by the above-described method for the liquid developer (A) except that, in the preparation of toner particles (1) in Example A, the release agent is changed from the paraffin wax to a polyethylene wax (Polywax500, manufactured by Baker Petrolite, melting temperature: 86° C.), and the composition is changed such that, in the toner, the content of the amorphous polyester resin is 76%, the content of the crystalline polyester resin is 7%, the content of the pigment (C. I. Pigment Blue 15:3) is 8%, and the content of the release agent (polyethylene wax) is 9%.

Liquid Developer C6

A liquid developer C6 is obtained by the above-described method for the liquid developer (A) except that, in the preparation of toner particles (1) in Example A, the release agent is changed from the paraffin wax to a FT wax (FT-0070, manufactured by NIPPON SEIRO CO., LTD., melting temperature: 72° C.), and the composition is changed such that, in the toner, the content of the amorphous polyester resin is 76%, the content of the crystalline polyester resin is 7%, the content of the pigment (C. I. Pigment Blue 15:3) is 8%, and the content of the release agent (FT wax) is 9%.

Liquid Developer C7

A liquid developer C7 is obtained by the above-described method for the liquid developer (A) except that, in the preparation of toner particles (1) in Example A, the release agent is changed from the paraffin wax to a synthesis wax (L-996, manufactured by Chukyo Yushi Co., Ltd., melting temperature: 99° C.), and the composition is changed such that, in the toner, the content of the amorphous polyester resin is 76%, the content of the crystalline polyester resin is 7%, the content of the pigment (C. I. Pigment Blue 15:3) is 8%, and the content of the release agent (synthesis wax) is 9%.

Evaluation

The liquid developers C1 to C7 are used and the relationship between document offset resistance and the amount of the carrier solution on the surface of a toner image during passing through the most-downstream roller pair (first roller pair) is examined.

In the image forming apparatus used in Example A, the solid-content concentration of the toner image and the carrier solution immediately before the non-contact infrared heating unit is set to be 30% by mass.

Heating at a temperature equal to or higher than the melting temperature of the release agent is firstly applied by the heating with the non-contact infrared heating unit.

Solid images are formed as in Example A except that the liquid developers C1 to C7 are used as the liquid developers and the amounts of the carrier solution on the surfaces of the toner images during passing through the nip of the most-downstream roller pair (first roller pair) are controlled to be the amounts described in Table 3 below.

Subsequently, the images of the obtained fixed images for each liquid developer are brought into contact with each other and left for 7 days under a load of 80 g/cm$^2$ in an environmental chamber at a temperature of 55° C. and a humidity of 50%. After that, the document offset resistance is evaluated. The results are summarized in Table 4 below.

Evaluation System

A: images have been separated from each other with no application of force

B: images have been separated from each other with application of force and the separated images are not degraded C: Slight image transfer is observed D: Noticeable image transfer is observed

TABLE 3

| | | Y | Z | Formula (1) | Examples | | | |
|---|---|---|---|---|---|---|---|---|
| | | | | | C 1 to 7 | C 8 to 14 | C 15 to 21 | C 22 to 28 |
| | | | | | Amount of release agent in the most-downstream nip [g/m$^2$] | | | |
| | | Concentration of release agent [% by mass] | Concentration of solid content [% by mass] | a = 0.005/([0.01 × Z] × [0.01 × Y]/{1 − [0.01 × Z] × [1 − 0.01 × Y]}) | 0.010 | 0.005 | 0.003 | 0.001 |
| | | | | | Amount of carrier solution in the most-downstream nip [g/m$^2$] | | | |
| Liquid developer | C1 | 5 | 30 | 0.2383 | 0.477 | 0.239 | 0.144 | 0.048 |
| | C2 | 9 | 30 | 0.1346 | 0.271 | 0.136 | 0.082 | 0.028 |
| | C3 | 13 | 30 | 0.0947 | 0.190 | 0.095 | 0.057 | 0.019 |
| | C4 | 9 | 30 | 0.1346 | 0.271 | 0.136 | 0.082 | 0.028 |
| | C5 | 9 | 30 | 0.1346 | 0.272 | 0.137 | 0.083 | 0.029 |
| | C6 | 9 | 30 | 0.1346 | 0.271 | 0.136 | 0.082 | 0.028 |
| | C7 | 9 | 30 | 0.1346 | 0.270 | 0.135 | 0.081 | 0.027 |

TABLE 4

| | | Examples | | | |
|---|---|---|---|---|---|
| | | C 1 to 7 | C 8 to 14 | C 15 to 21 | C 22 to 28 |
| | | Amount of release agent in the most-downstream nip [g/m$^2$] | | | |
| | | 0.010 | 0.005 | 0.003 | 0.001 |
| Liquid developer | C1 | B | B | D | D |
| | C2 | B | B | D | D |
| | C3 | B | B | D | D |
| | C4 | B | B | C | D |
| | C5 | B | B | D | D |
| | C6 | B | B | D | D |
| | C7 | A | B | C | D |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier;

a charging unit that charges a surface of the image carrier;

an electrostatic latent image forming unit that forms an electrostatic latent image on the charged surface of the image carrier;

a developing unit that contains a liquid developer containing a toner and a carrier solution containing a non-volatile oil and that develops the electrostatic latent image with the liquid developer to form a toner image on the surface of the image carrier;

a transfer unit that transfers the toner image onto a recording medium; and a fixing unit that includes at least one pair of first and second rotating members for fixing that form a nip between the first and second rotating members, and that applies heat and pressure to the recording medium having the transferred toner image and being passed through the nip to fix the toner image on the recording medium, wherein a condition (A) described below is satisfied:

condition (A): an amount of the carrier solution on a surface of the toner image is about 0.7 g/m$^2$ or less during passing of the recording medium through a nip of a most-downstream pair of the at least one rotating-member pair in a leading direction of the recording medium.

2. The image forming apparatus according to claim 1, wherein the toner contains a release agent, and when a concentration of the release agent in the toner is represented by Y (% by mass) and a solid-content concentration of the toner image and the carrier solution immediately before application of heat to the toner image at a temperature equal to or higher than a melting temperature of the release agent is represented by Z (% by mass), a condition (B) described below is satisfied:

condition (B): the amount of the carrier solution on the surface of the toner image is not less than about a (g/m$^2$) represented by a formula (1) below during passing of the recording medium through the nip of the most-downstream pair of the at least one rotating-member pair in the leading direction of the recording medium, $$a=0.005/([0.01\times Z]\times[0.01\times Y]/\{1-[0.01\times Z]\times[1-0.01\times Y]\}) \quad \text{formula (1).}$$

3. An image forming method comprising:

charging a surface of an image carrier;

forming an electrostatic latent image on the charged surface of the image carrier;

developing the electrostatic latent image with a liquid developer containing a toner and a carrier solution containing a non-volatile oil, to form a toner image on the surface of the image carrier;

transferring the toner image onto a recording medium; and applying heat and pressure to the recording medium having the transferred toner image and being passed through a nip, with a fixing unit that includes at least one pair of first and second rotating members for fixing that form the nip between the first and second rotating members, to fix the toner image on the recording medium, wherein a condition (A) described below is satisfied:

condition (A): an amount of the carrier solution on a surface of the toner image is about 0.7 g/m$^2$ or less during passing of the recording medium through a nip of a most-downstream pair of the at least one rotating-member pair in a leading direction of the recording medium.

4. The image forming method according to claim 3, wherein the toner contains a release agent, and when a concentration of the release agent in the toner is represented by Y (% by mass) and a solid-content concentration of the toner image and the carrier solution immediately before application of heat to the toner image at a temperature equal to or higher than a melting temperature of the release agent is represented by Z (% by mass), a condition (B) described below is satisfied:

condition (B): the amount of the carrier solution on the surface of the toner image is not less than about a ($g/m^2$) represented by a formula (1) below during passing of the recording medium through the nip of the most-downstream pair of the at least one rotating-member pair in the leading direction of the recording medium, $$a=0.005/([0.01\times Z]\times[0.01\times Y]/\{1-[0.01\times Z]\times[1-0.01\times Y]\}) \quad \text{formula (1).}$$

* * * * *